US007918117B2

(12) United States Patent
Frolov et al.

(10) Patent No.: US 7,918,117 B2
(45) Date of Patent: Apr. 5, 2011

(54) FASTENER SHIELD DEVICE FOR LOCKS

(75) Inventors: George Frolov, Farmington, CT (US); Vu D. Nguyen, West Hartford, CT (US)

(73) Assignee: Harrow Products, Inc., Woodcliff Lake, NJ (US)

( * ) Notice: Subject to any disclaimer, the term of this patent is extended or adjusted under 35 U.S.C. 154(b) by 0 days.

(21) Appl. No.: 12/813,575

(22) Filed: Jun. 11, 2010

(65) Prior Publication Data

US 2010/0242555 A1 Sep. 30, 2010

Related U.S. Application Data

(60) Continuation of application No. 11/368,648, filed on Mar. 6, 2006, now Pat. No. 7,757,524, which is a division of application No. 10/658,815, filed on Sep. 8, 2003, now Pat. No. 7,007,526.

(51) Int. Cl.
*E05B 17/00* (2006.01)

(52) U.S. Cl. ..... 70/431; 70/54; 70/56; 70/277; 70/416; 70/423; 70/455

(58) Field of Classification Search ..... 70/54–56, 70/416, 417, 448, 450, 451, 427, 454, 423, 70/455, 277, DIG. 43, DIG. 56, DIG. 57, 70/431

See application file for complete search history.

(56) References Cited

U.S. PATENT DOCUMENTS

| | | | |
|---|---|---|---|
| 249,340 | A | 11/1881 | Grill et al. |
| 572,988 | A | 12/1896 | Hecker |
| 958,849 | A | 5/1910 | Benedict |
| 1,252,815 | A | 1/1918 | Kovalski |
| 2,883,849 | A | 4/1959 | Lorenzo |
| 2,906,112 | A | 9/1959 | Vahlstrom |
| 3,263,463 | A | 8/1966 | Duval et al. |
| 3,475,932 | A | 11/1969 | Germanton |
| 3,705,508 | A | 12/1972 | Fritsch et al. |
| 3,735,613 | A | 5/1973 | Diebel et al. |
| 3,747,377 | A | 7/1973 | Van Deudekom |
| 3,834,198 | A | 9/1974 | Wiczer |
| 3,882,703 | A | 5/1975 | Hermann |
| 3,907,343 | A | 9/1975 | Goodwin |
| 4,148,092 | A | 4/1979 | Martin |
| 4,149,212 | A | 4/1979 | Willach |
| 4,196,422 | A | 4/1980 | Swigert et al. |
| 4,423,611 | A | 1/1984 | Neyret et al. |
| 4,457,148 | A | 7/1984 | Johansson et al. |
| 4,637,237 | A | 1/1987 | Witkoski et al. |
| 4,640,110 | A | 2/1987 | Fish et al. |
| 4,773,243 | A | 9/1988 | Lukich |
| 4,802,353 | A | 2/1989 | Corder et al. |
| 4,813,250 | A | 3/1989 | Yeh |
| 4,820,330 | A | 4/1989 | Lin |
| 4,936,122 | A | 6/1990 | Osada |

(Continued)

*Primary Examiner* — Suzanne D Barrett
(74) *Attorney, Agent, or Firm* — Michael Best & Friedrich LLP

(57) ABSTRACT

A lock assembly including a housing, a fastener that has a head, a lock member that is movable between a first position and a second position, and a barrier that is movably disposed within the housing. The barrier is displaceable between a first position at which the barrier at least partially covers the fastener head, and a second position at which the fastener head is generally accessible. The barrier is coupled with the lock member such that the barrier displaces from the barrier first and second positions when the lock member displaces between the lock member first and second positions.

9 Claims, 16 Drawing Sheets

U.S. PATENT DOCUMENTS

| | | | | |
|---|---|---|---|---|
| 4,966,018 | A | 10/1990 | Hauber | |
| 4,995,248 | A | 2/1991 | Liu | |
| 5,027,629 | A | 7/1991 | Liu | |
| 5,057,830 | A | 10/1991 | Eisermann | |
| 5,083,122 | A | 1/1992 | Clark | |
| 5,113,675 | A | 5/1992 | Uyeda | |
| 5,136,870 | A | 8/1992 | Gartner et al. | |
| 5,172,574 | A | 12/1992 | Perfetto | |
| 5,220,816 | A | 6/1993 | Fish et al. | |
| 5,475,996 | A | 12/1995 | Chen | |
| 5,640,863 | A | 6/1997 | Frolov | |
| 5,737,946 | A | 4/1998 | Sole et al. | |
| 5,946,955 | A | 9/1999 | Suggs et al. | |
| 6,145,353 | A | 11/2000 | Doucet | |
| 6,286,347 | B1 | 9/2001 | Frolov | |
| 6,474,119 | B1 | 11/2002 | Halvorson et al. | |
| 6,487,884 | B1 | 12/2002 | Constantinou | |
| 6,601,413 | B1 | 8/2003 | Vito | |
| 6,651,468 | B2 | 11/2003 | Aramburu et al. | |
| 6,714,118 | B1 | 3/2004 | Frolov et al. | |
| 6,725,693 | B2 | 4/2004 | Yu et al. | |
| 6,758,070 | B2 | 7/2004 | Yu et al. | |
| 6,807,834 | B2 | 10/2004 | Tsai | |
| 6,837,081 | B2 | 1/2005 | Aramburu et al. | |
| 6,843,084 | B2 | 1/2005 | Porter | |
| 6,845,642 | B2 | 1/2005 | Imedio | |
| 6,848,284 | B2 | 2/2005 | Chen | |
| 6,868,703 | B2 | 3/2005 | Molzer | |
| 7,007,526 | B2 * | 3/2006 | Frolov et al. | 70/277 |
| 7,047,774 | B1 | 5/2006 | Gogel | |
| 7,757,524 | B2 * | 7/2010 | Frolov et al. | 70/277 |
| 2004/0177663 | A1 | 9/2004 | Walsh, III et al. | |

* cited by examiner

FASTENER SHIELD DEVICE FOR LOCKS

RELATED APPLICATIONS

This application is a continuation of U.S. patent application Ser. No. 11/368,648, filed Mar. 6, 2006, which is a divisional of U.S. patent application Ser. No. 10/658,815, filed Sep. 8, 2003, now U.S. Pat. No. 7,007,526 entitled "Electronic Clutch Assembly for a Lock System", each of which is incorporated herein by reference in their entirety.

BACKGROUND OF THE INVENTION

The present invention relates to locksets, and more particularly to electronic-actuated locksets.

Locksets are generally known and typically include a latch or deadbolt engageable with a strike so as to "lock" or retain a door disposed within a doorframe. Certain known locksets include electronic components, such as key pad, card readers, etc., that are used to operate the mechanical components of the lockset so as to controllably displace the latch or deadbolt between locked and unlocked positions. Such mechanical components include one or more rotatable spindles which operate a mechanism or component, such as a latch bolt, directly attached to or connected with the latch.

SUMMARY OF THE INVENTION

In one construction, the invention provides a shield device for a fastener of a lock assembly. The lock assembly is adjustable between an inoperable state and an operable state and includes a housing. The shield device includes a barrier that is movably disposeable within the housing and configured to displace between a first position at which the barrier at least partially covers the fastener and a second position at which the fastener is generally accessible. The barrier is completely disposed within the housing in the second position. The barrier is disposeable in the first position when the lock assembly is arranged in the inoperable state and is disposeable in the second position when the lock assembly is arranged in the operable state.

In another construction, the invention provides a lock assembly including a housing, a fastener that has a head, a lock member that is movable between first and second positions, and a barrier that is movably disposed within the housing. The barrier is displaceable between a first position at which the barrier at least partially covers the fastener head and a second position at which the fastener head is generally accessible. The barrier is coupled with the lock member such that the barrier displaces from the barrier first and second positions when the lock member displaces between the lock member first and second positions.

In yet another construction, the invention provides a shield device for preventing access to a fastener of a lock assembly. The lock assembly includes a housing and the shield device includes a barrier that is disposeable within the housing. The barrier is configured to be displaceable between a first position at which the barrier at least partially covers the fastener and a second position at which the barrier is spaced from the fastener such that the fastener is generally accessible. The barrier is completely disposed within the housing in the second position. The shield device also includes means for displacing the barrier between the first and second positions.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings:

FIG. 17, are each an enlarged, broken-away plan view of the lock system, each showing a separate one of the two positions of the fastener shield;

FIG. 18, are each a broken-away plan view of a portion of the fastener shield device and the lock housing, each showing a separate one of the two positions of the fastener shield;

FIG. 20, are each a broken-away, rear perspective view of the lock system, each showing an alternative construction of an output cam of the lock system.

DETAILED DESCRIPTION OF THE INVENTION

Figure 1:
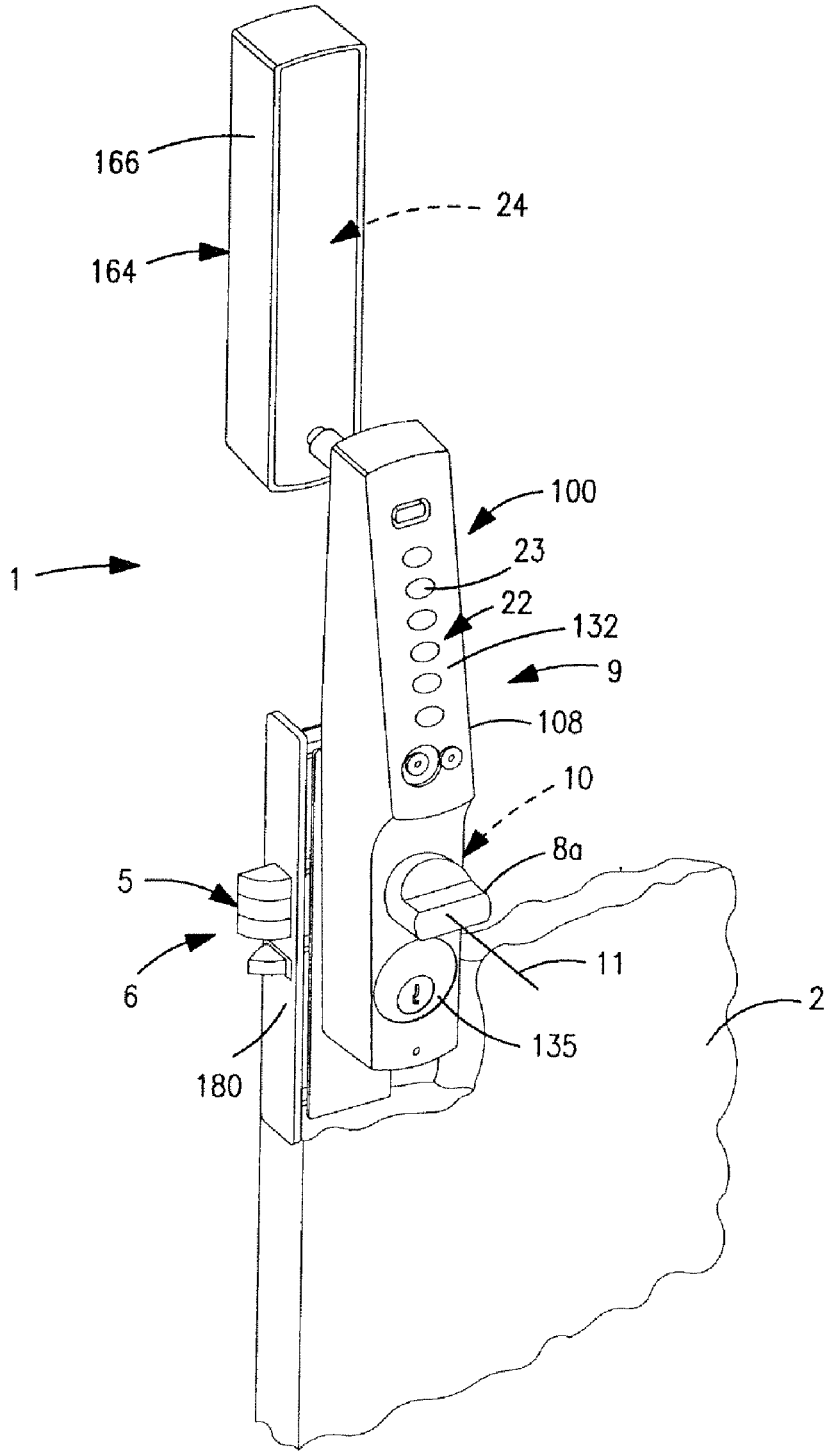
FIG. 1 is a front perspective view of a lock system into which an electronic clutch assembly in accordance with the present invention is preferably installed.

Certain terminology is used in the following description for convenience only and is not limiting. The words "right", "left", "lower", "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words or similar import.

Referring now to the drawings in detail, wherein like numbers are used to indicate like elements throughout, there is shown in FIGS. 1-20 a presently preferred embodiment of an electronic clutch assembly 10 for a lock system 1 of a door 2. The lock system 1 preferably has a latch 5 and first and second rotatable spindles 3, 4, respectively, one of the two spindles 3 and 4 being operatively connected (or connectable) with the latch 5 to displace the latch 5 between a first, "locked" latch position (FIG. 1) and a second, "unlocked" position (not shown). The clutch assembly 10 basically comprises a clutch 12 coupled with the first spindle 3 and having a connective portion 14 engageable with the second spindle 4. The clutch 12 is linearly displaceable in a first direction $A_1$ generally along a first or "assembly" axis 11 between a first position $C_1$ (FIGS. 4 and 7), in which the connective portion 14 is non-engaged with the second spindle 4, and a second position $C_2$ (FIGS. 3 and 8) in which the connective portion 14 is engaged with the second spindle 4, and vice-versa. It should be noted that the clutch positions $C_1$, $C_2$ are indicated in the drawings by referencing a designated center point "$P_C$" of the clutch 12 for convenience of discussion only, the particular point $P_C$ having no particular significance such that any other point on the clutch 12 may alternatively be used.

Further, a mechanism 15 is operatively connected with the clutch 12 and is configured to linearly displace the clutch 12 along the assembly axis 11. Preferably, the mechanism 15 includes a cam 16 engageable with the clutch 12 and an electric actuator 18 configured to move the cam 16 into and out of engagement with the clutch 12. The cam 16 is displaceable generally along a second or cam axis 17, the second axis 17 extending generally perpendicularly with respect to the first axis 11, and configured to linearly displace the clutch 12 between the first and second clutch positions $C_1$, $C_2$, respectively. More specifically, the clutch 12 preferably has an outer contact surface 13 and the cam 16 has a camming surface 19 contactable with the clutch contact surface 13 such that when the cam 16 displaces along the second axis 17, the camming surface 19 slides against the contact surface 13 to displace the clutch 12 between the two clutch positions $C_1$ and $C_2$.

Furthermore, the electric actuator 18 is operatively connected with the cam 16 and is configured to linearly displace the cam 16 along the second axis 17 such that the clutch 12 alternatively couples the second spindle 4 with the first spindle 3 and uncouples the second spindle 4 from the first spindle 3. Preferably, a biasing member 20 is operatively connected with the clutch 12 and is configured to displace the clutch 12 from the second clutch position $C_2$ and toward the first clutch position $C_1$ when the cam 16 is out of engagement with the clutch 12. Further, the electronic clutch assembly 10 preferably further comprises an input device 22 configured to generate an input signal and a logic circuit 24 (FIG. 1). The logic circuit 24 is electrically connected with the input device 22 and with the actuator 18 and is configured to receive the input signal (i.e., from the input device 22) and to generate and transmit a control signal to the electric actuator 18 to cause the actuator 18 to displace the cam 16 in response to the control signal. Thus, the logic circuit 24 ultimately controls the coupling and uncoupling of the respective first and second spindles 3 and 4 by operating the clutch 12 through controlled displacement of the cam 16.

Preferably, the latch 5 is part of a lockset 6 (as described below) and the first spindle 3 is an "output" spindle operatively connected with the latch 5 through an output cam 7, as discussed below, and the second spindle 4 is preferably an "input" spindle with a handle portion 8. The clutch assembly 10 and the two spindles 3, 4 are each preferably installed within a lock actuator assembly 9 operatively connected with the lockset 6, each spindle 3 and 4 being rotatable about the first, assembly axis 11, which extends through the actuator assembly 9. As such, the second spindle 4 is freely rotatable when the clutch 12 is disposed in the first clutch position $C_1$ and the rotation of the second spindle 4 rotatably displaces the first spindle 3 when the clutch 12 is disposed in the second clutch position $C_2$. More specifically, the second spindle 4 is rotatable about the first axis 11, while the first spindle 3 remains generally stationary with respect to the first axis 11, when the clutch 12 is disposed in the first clutch or nonengaged position $C_1$. Further, the two spindles 3 and 4 and the clutch 12 rotate as a single unit about the assembly axis 11 to displace the latch 5 (i.e., by means of the cam 7) between the locked and unlocked latch positions when the clutch 12 is disposed in the second or engaged clutch position $C_2$. Having described the basic elements of the clutch assembly 10 of the present invention, a detailed description of these and additional components is provided below.

Referring to FIGS. 3-10, the clutch 12 includes a longitudinal central axis 29 and is preferably formed of two connected body pieces 30 and 32. Specifically, the clutch includes a complex-shaped main body 30 having first and second ends 30*a*, 30*b*, respectively, and a guide rod 32 extending outwardly from the second end 30*b* and generally along the clutch axis 29. When the clutch 12 is installed in a lock actuator assembly 9, the clutch axis 29 is substantially collinear with the assembly axis 11 and the main body 30 and guide rod 32 are each generally centered about the axis 11. Further, although the clutch 12 is preferably formed of two connected pieces 30 and 32, the clutch 12 may alternatively be of one-piece construction, such that the main body 30 and rod 32 are integrally formed portions of a single clutch piece (not shown).

Preferably, the main body 30 of the clutch 12 includes an end shaft portion 34 disposed at the first end 30*a*, an annular shoulder portion 36, an intermediate shaft portion 38 and a conical portion 40 disposed at the second end 30*b*. Further, a central bore 31 extends into the main body 30 from the second end 30*b* and is configured to receive an end 32*a* of the guide rod 32, preferably with a friction fit, to thereby connect the two clutch pieces 30, 32. However, the rod 32 may be attached to the clutch main body 30 by any other appropriate means, such as by a threaded opening, weldment material, etc. (no alternatives shown). Further, the main body 30 is preferably of one-piece construction such that all the body portions 34, 36, 38 and 40 are integrally formed or connected together, but may alternatively be formed of separate members 34, 36, 38 and 40 attached together by any appropriate means (e.g., threaded connections, weldment, etc).

Further, the end shaft portion 34 of the main body 30 is preferably generally rectangular-shaped and slidably disposeable within a mating opening 82 in the first spindle 3, as described below, so as to couple the clutch 12 and spindle 3. More specifically, the end shaft portion 34 is sized to fit within the first spindle opening 82 so as to be slideable axially within the opening 82, such that the clutch 12 is linearly displaceable with respect to the first spindle 3 in order to engage with and disengage from the second spindle 4. However, the free end 34*a* of the rectangular end shaft portion 34 always remains at least partially disposed within the rectangular spindle opening 82 at all positions of the clutch 12 along the axis 11, such that any rotational displacement of the clutch 12 causes the first spindle 3 to rotate through an equal angular distance. Although preferably rectangular, the end shaft portion 34 may alternatively have any other appropriate shape, such as cross-shaped, partially circular with a flat surface, etc. As a further alternative, the outer end 12*a* of the clutch 12 may be formed with an appropriately-shaped opening (not shown) sized to fit about the inner end of the first spindle 3 such that the clutch outer end 12*a* slides over the spindle 3.

Further, the annular shoulder portion 36 of the main body 30 is connected to an opposing, second end 34*b* of the end shaft portion 34 and is sized radially larger than the shaft portion 34. The shoulder portion 36 includes a radial stop surface 35 that is contactable with the inner end 3*a* of the first spindle 3 when the clutch 12 is located in the first clutch position $C_1$ so as to prevent further displacement of the clutch 12 in an outward direction along the axis 11, as discussed in further detail below. The intermediate shaft portion 38 is generally shaped as a circular cylinder and extends between the shoulder portion 36 and the conical portion 40. The shaft portion 38 is sized radially smaller than both the shoulder portion 36 and the conical portion inner end 40*a* such that a generally annular locking recess 39 is defined between the shoulder and conical portions 36, 40, respectively. The locking recess 42 extends circumferentially and completely about the first axis 11 and is configured to receive a locking projection 60 (described below) of the cam 16, such that the projection 60 is disposed against a radial stop surface (described below) of the conical portion 40 to retain the clutch in the second position $C_2$, as discussed below.

Figure 7:
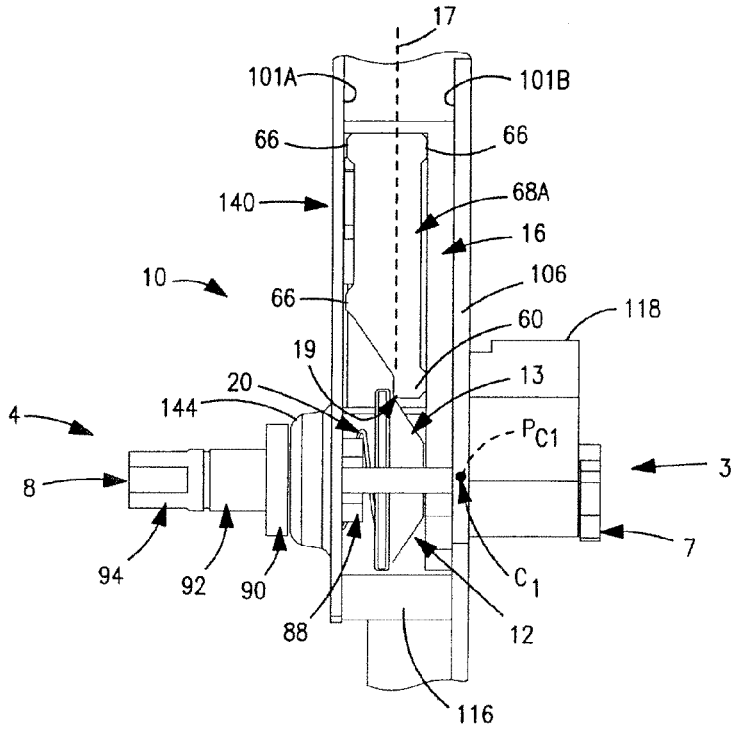
FIG. 7 is a broken-away, side cross-sectional view of the electronic clutch mechanism showing the clutch in the first, nonengaged position.
Figure 8:
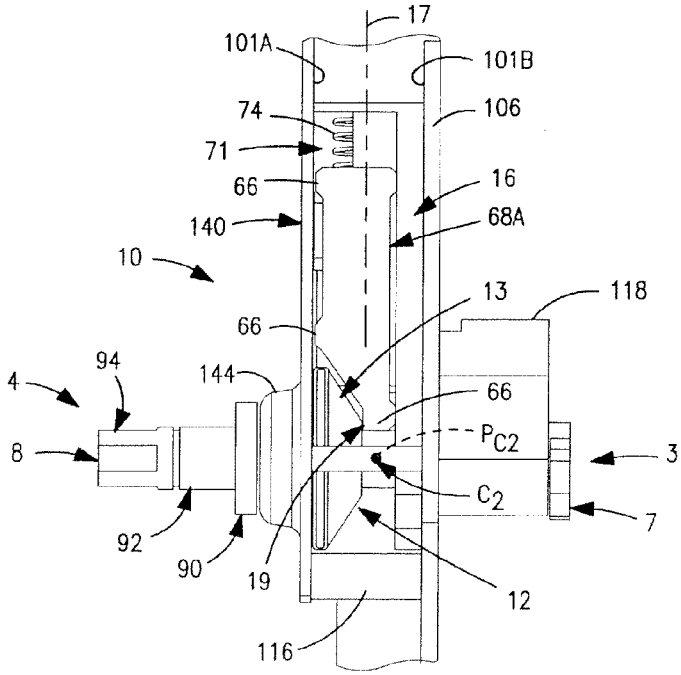
FIG. 8 is another broken-away, side cross-sectional view of the clutch mechanism of FIG. 7, showing the clutch in the engaged position.
Figure 9:
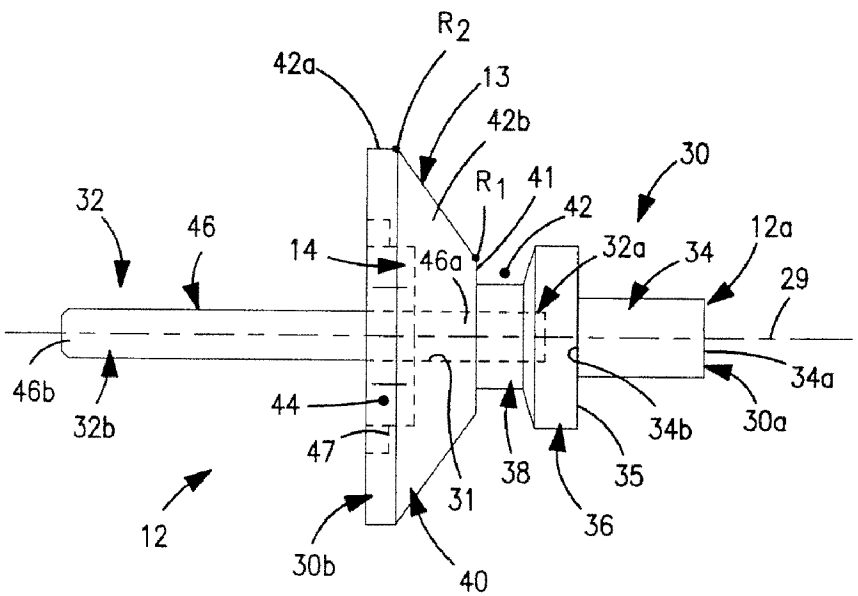
FIG. 9 is a side plan view of a preferred clutch.

Still referring to FIGS. 3-10, the conical portion 40 of the clutch 12 is disposed at the second end 30*b* of the main body 30 and provides both the connective portion 14 and the contact surface 13. The conical body portion 40 is shaped generally as a truncated cone and has a first or stop radial surface 41, a second or end radial surface 43, a first, circular circumferential surface 42 adjacent to the second radial surface 43 and a second, angled outer circumferential surface 42*b* extending between the first radial surface 41 and the first circumferential surface 42*a*. The angled surface 42*b* provides the clutch contact surface 13 and extends circumferentially at least partially, and most preferably entirely, about the first axis 11. As such, the contact surface 13 is substantially continuous and rotationally symmetric about the assembly axis 11 (i.e., when installed in the lockset 1), so that substantially identical sections of the contact surface 13 face generally toward the cam 16 irrespective of the actual rotational position or orientation of the clutch 12 about the axis 11. As indicated in FIG. 9, the contact surface 13 extends both axially and radially between a first, most proximal radial position $R_1$ with respect to the primary axis 11 and a second, most distal radial position $R_2$ with respect to the first axis 11, such that the surface 13 faces generally in a second direction $A_2$ along the assembly axis 11. With the described structure and orientation of the clutch contact surface 13, the displacement of the cam 16 toward the first axis 11 pushes the camming surface 19 against the contact surface 13, which causes the clutch 12 to be displaced or "pushed" generally along the axis 11 in the first axial direction $A_1$.

Furthermore, the conical body portion 40 preferably has an engagement opening 44 providing the clutch connective portion 14. More specifically, the engagement opening 44 is configured to receive an inner end 4*a* of the second spindle 4 such that the clutch 12 is linearly displaceable (i.e., along the first axis 11) relative to the spindle inner end 4*a*, but relative rotational displacement between the clutch 12 and the spindle 4 (i.e., about the axis 11) is substantially prevented.

Figure 6:
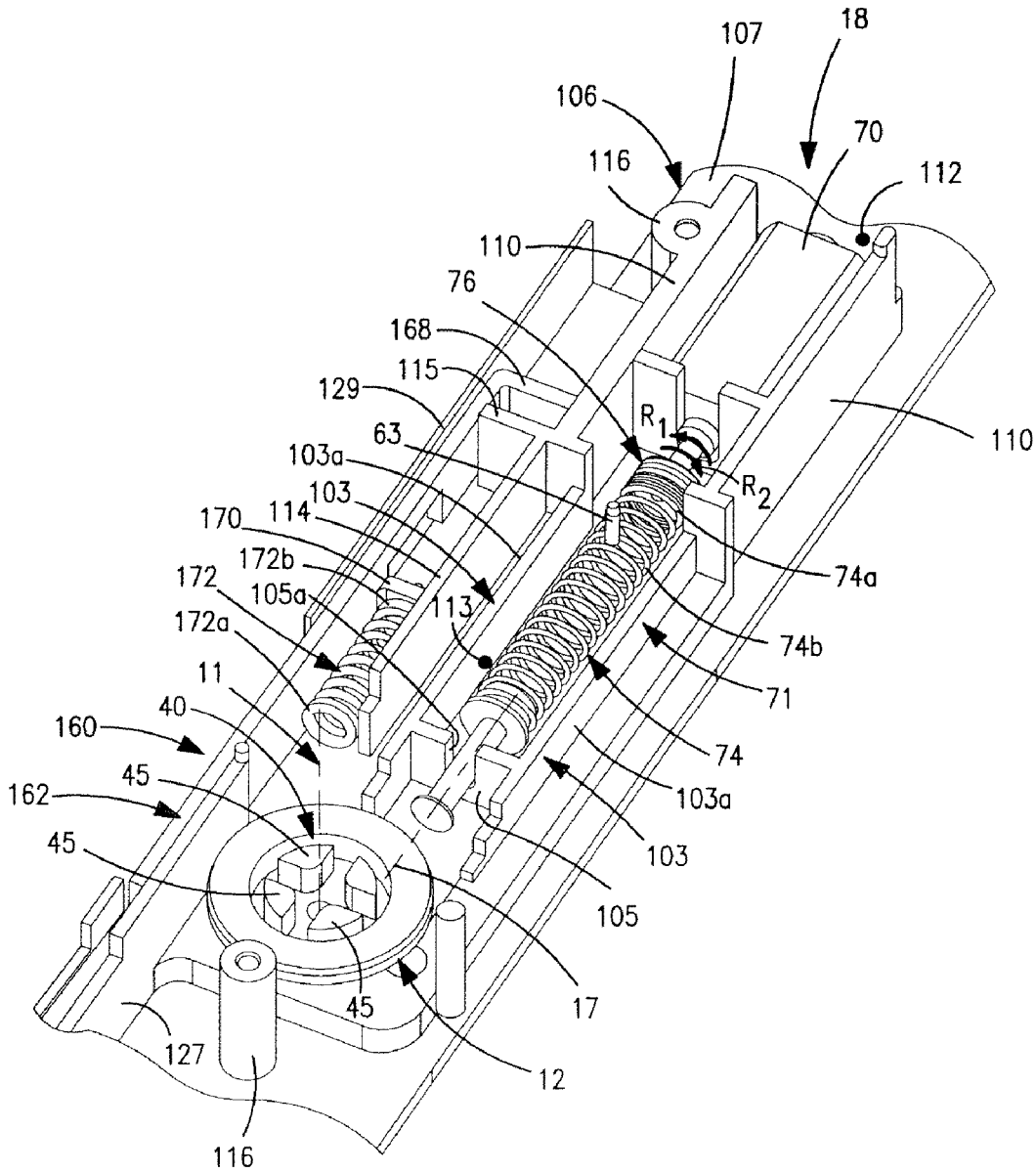
FIG. 6 is another broken-away, perspective view of the clutch mechanism, shown with a cam member and input spindle removed.
Figure 10:
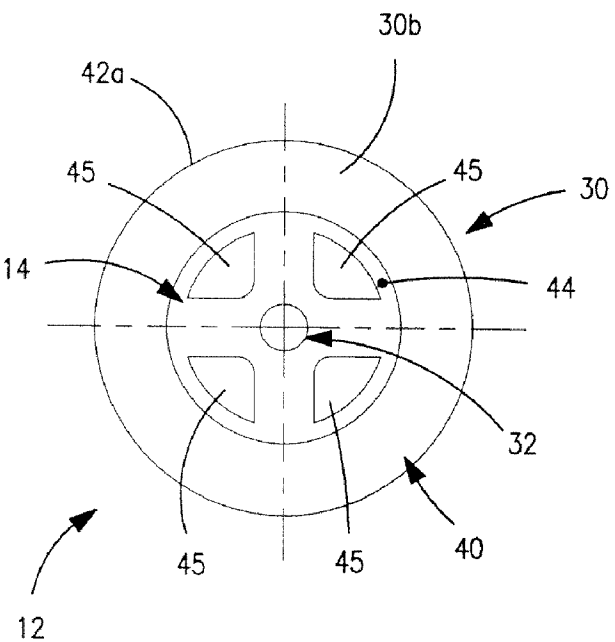
FIG. 10 is an end plan view of the preferred clutch.
Figure 11:
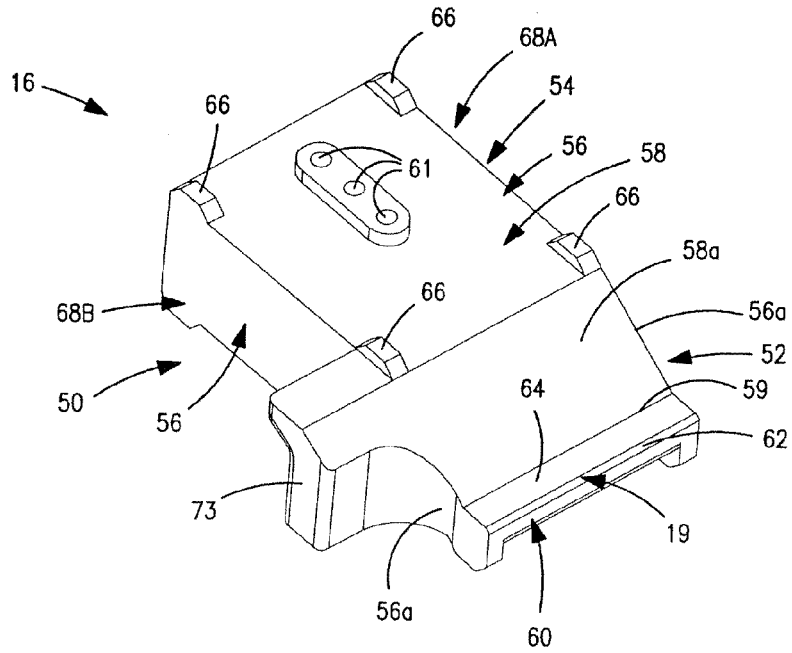
FIG. 11 is a top perspective view of a preferred cam.

As such, when the spindle end portion 4*a* is disposed within the clutch opening 42, rotational displacement of the second spindle 4 causes a substantially equal rotational displacement of the clutch 12, and thereby also the first spindle 3 coupled with the clutch 12. As best shown in FIGS. 6 and 10, the clutch connective portion 14 preferably includes four generally rectangular lugs 45 extending outwardly from an inner radial surface 47 bounding a portion of the opening 44, the lugs 45 extending generally axially along and spaced circumferentially about the axis 11. The lugs 45 are configured to mate with a generally cross-shaped shaft portion of the second spindle 4, as described below. Further, the radial surface section 47 of the opening 44 is contactable by the preferred biasing member 20, such that the biasing member 20 exerts a force on the clutch 12 through the surface 47, as described below. Although the above structure is presently preferred, the clutch opening 42 may alternatively be formed with any other appropriate shape, such as generally rectangular, semi-circular, etc. Further, the clutch 12 may be alternatively be formed without the engagement opening 44 and with a connective portion 14 configured to releasably engage with the second spindle 4 in another manner, such as a shaft portion disposeable within an opening of the second spindle 4, a friction surface contactable with a corresponding friction surface of the spindle 4, etc. (no alternatives shown).

Figure 3:
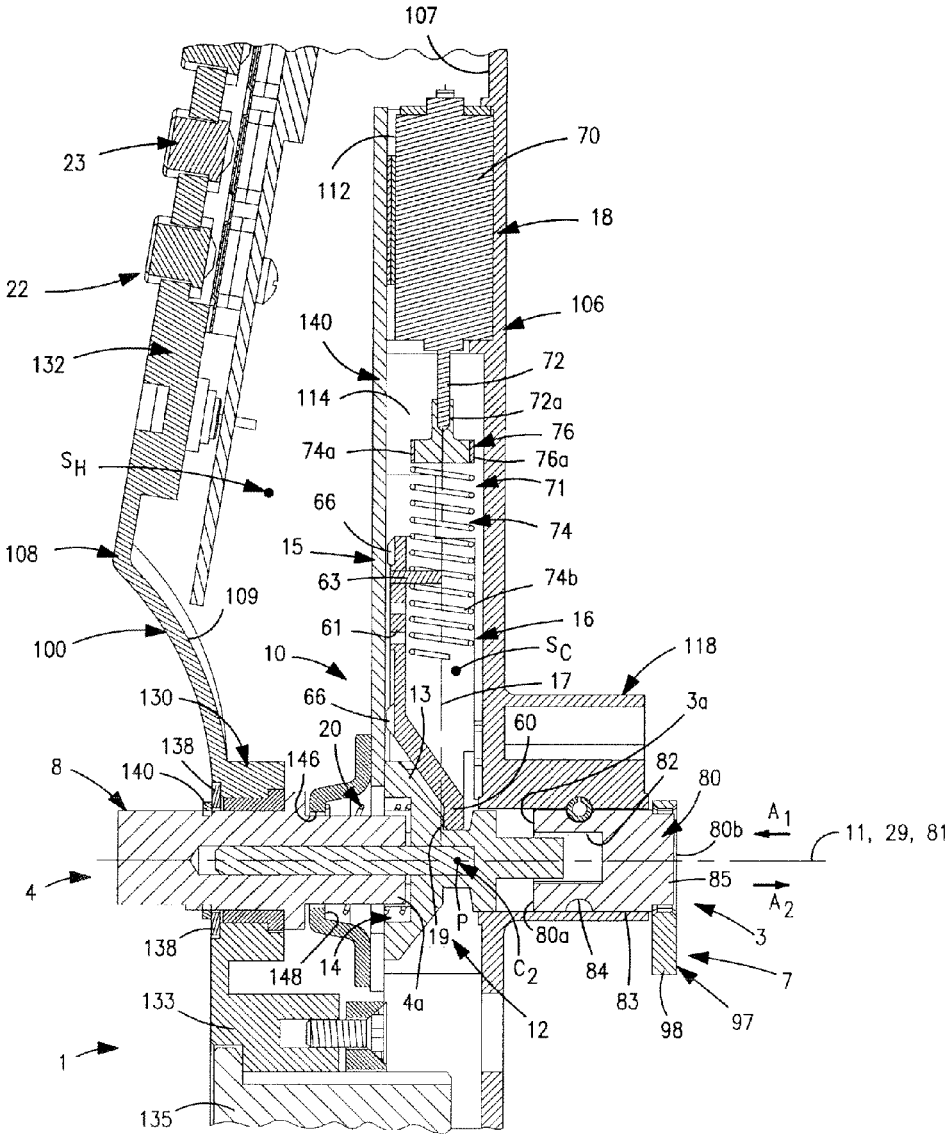
FIG. 3 is an enlarged, broken-away side cross-sectional view of the clutch mechanism, showing the clutch in the engaged position.
Figure 4:
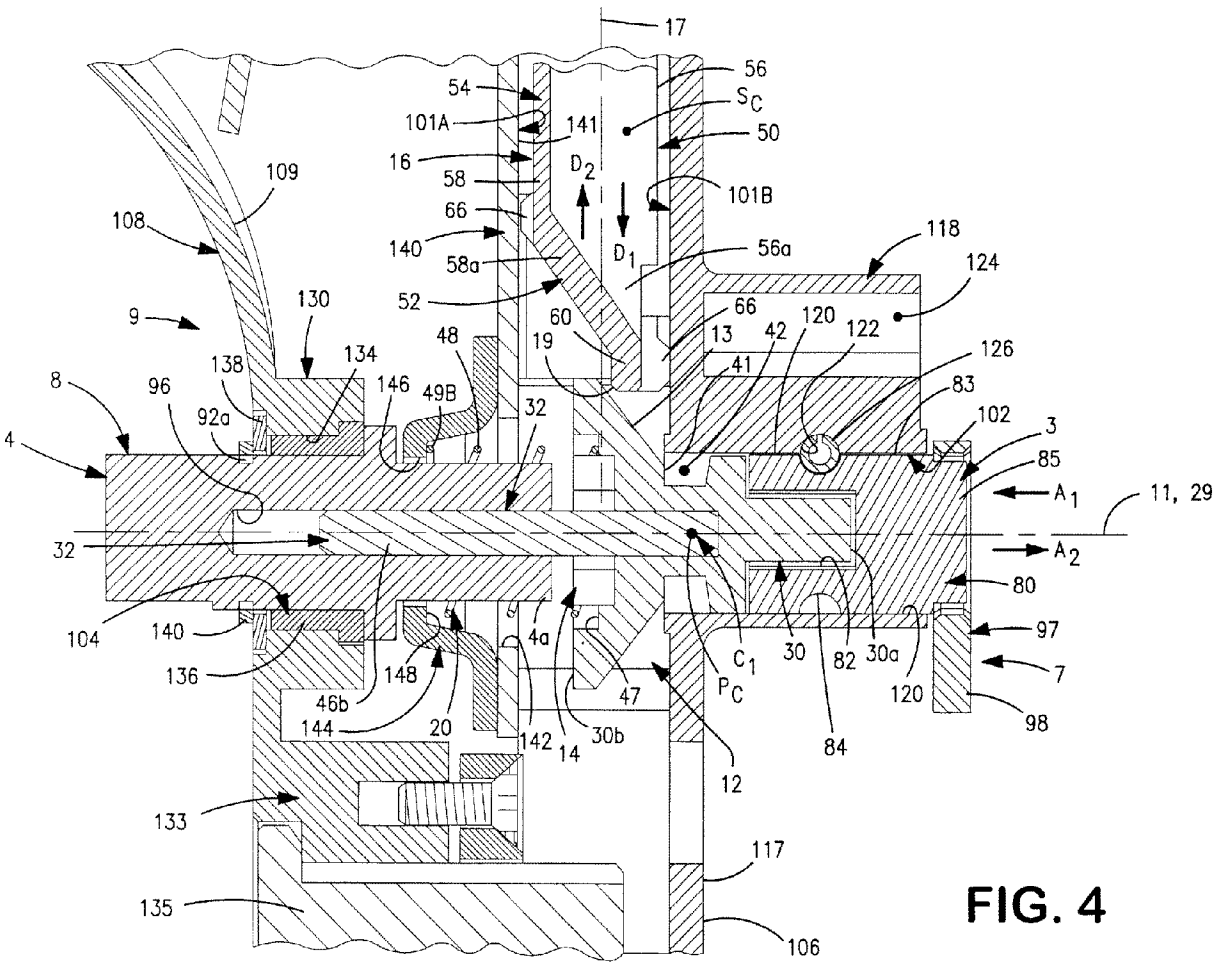
FIG. 4 is a more enlarged view broken-away side cross-sectional view of the clutch mechanism, showing the clutch in a nonengaged position.
Figure 5:
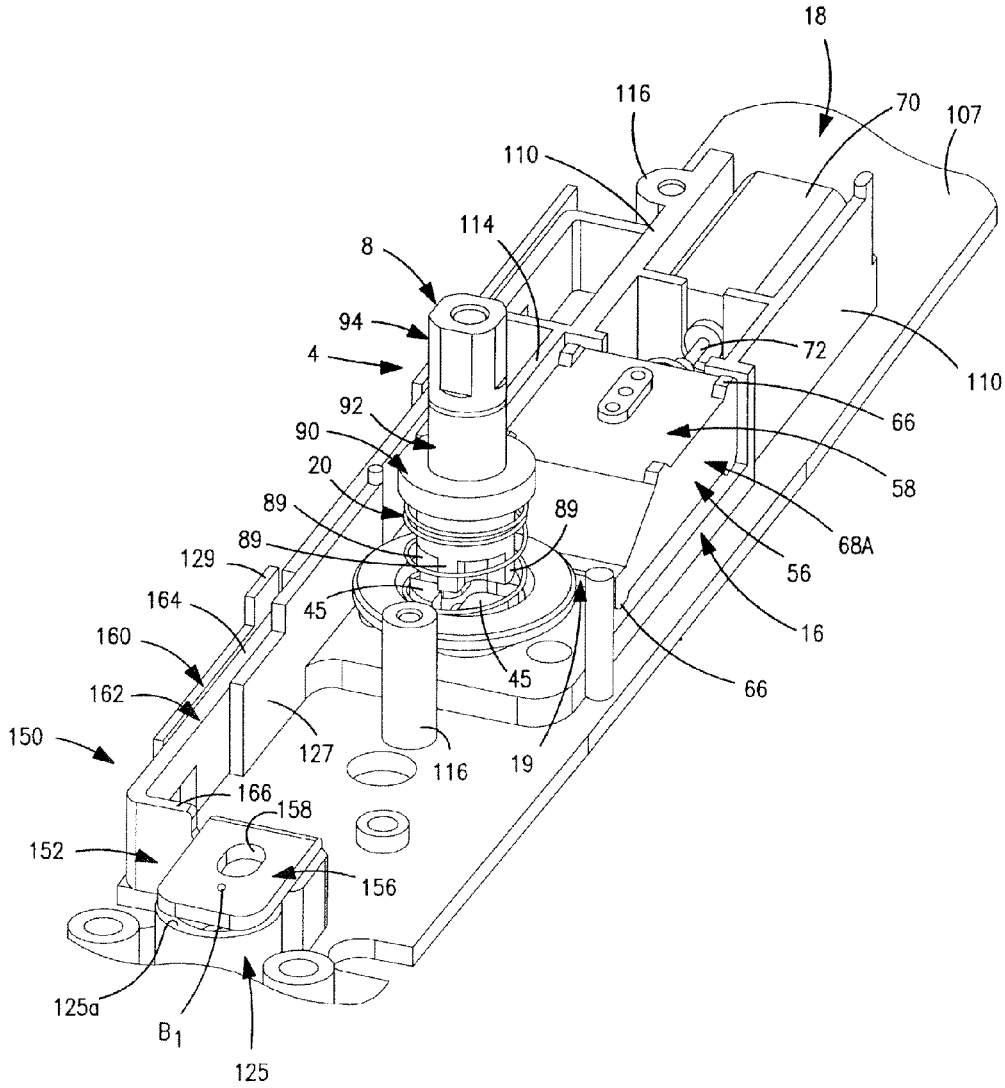
FIG. 5 is a broken-away, perspective view of the clutch mechanism, shown mounted on a base plate of the lockset.

Referring to FIGS. 3, 4 and 9, the guide rod 32 of the clutch 12 has a free end 32*b* sized to be received within a circular central bore 96 of the second spindle 4, which extends inwardly from the spindle inner end 4*a*. The guide rod 32 is preferably formed as a generally circular rod 46 having a first end 46*a* fixedly disposed within the main body bore 31, a discussed above, and a second end 46*b* slidably disposed within the second spindle bore 96. As such, when the clutch 12 displaces along the assembly axis 11 between the first and second clutch positions $C_1$, $C_2$, the guide rod 32 slides axially through the second spindle bore 96 so to generally retain the clutch 12 generally centered about the assembly axis 11. Thus, the guide rod 32 ensures proper engagement of the clutch connective portion 14 with the second spindle 4, as discussed above and in further detail below. Further, when the clutch 12 is in the first or nonengaged position $C_1$, the second spindle 4 is rotatably displaceable about the assembly axis 11, such that the spindle 4 slides around the guide rod 32, while the clutch rod 32 and main body 30 remain generally stationary with respect to the axis 11. Although it is preferred to construct the clutch 12 with the guide rod 32 as described herein, the clutch 12 may constructed without the rod 32 and be otherwise guided along the clutch axis 11, such as by a tubular sleeve (not shown) disposed about at least the clutch conical portion 40, such that an outermost circumferential surface 42*a* slides within the sleeve. Further, although not preferred, the clutch 12 may be formed without any guiding components or elements, such that the clutch 12 is supported and maintained on the assembly axis 11 merely by its connection with the first spindle 3.

Referring now to FIGS. 3, 4, 7 and 8, the biasing member 20 is preferably a conventional coil compression spring 48 operatively connected with the clutch 12. The spring 48 is configured to bias the clutch 12 along the assembly axis 11 from the second clutch position $C_2$ to the first clutch position $C_1$ when the cam 16 displaces along the cam axis 17 in a second direction $D_2$ generally away from the assembly axis 11. In other words, the spring 48 displaces the clutch 12 out of engagement with the second spindle 4 when the cam 16 disengages from (i.e., displaces out of contact with) the clutch 12. Preferably, the spring 48 has a first end 49A contactable with the inner radial surface section 47 of the clutch 12 and a second end 49B disposed against a facing radial surface 148 of the actuator assembly housing 100, as described below. Further, the spring 48 is generally disposed about the inner end 4*a* of the second spindle 4 and an inner section of the guide rod 32.

Although the compression coil spring 48 is preferred, the biasing member 20 may alternatively be another type of spring, such as an extension spring (not shown) extending between the clutch 12 and the first spindle 3 or even a different type of device. For example, the clutch assembly 10 may be provided with a spring-activated push/pull rod (not shown) or a pair of magnets (not shown) arranged to either repel the clutch 12 from the second position $C_2$ or to attract the clutch 12 to the first position $C_1$. As a further alternative, the electronic clutch assembly 10 may be constructed without any biasing member and having a mechanism 15 that positively displaces the clutch 12 in both directions $A_1$, $A_2$ between the first and second positions $C_1$, $C_2$, as discussed below.

Referring now to FIGS. 3-5, 7, 8, 11 and 12, the cam 16 is preferably constructed as a generally hollow, shell-like body 50 including a first, generally wedge-shaped camming portion 52, which includes the camming surface 19, and a second, generally rectangular slider portion 54. More specifically, the body 50 is primarily formed of two spaced-apart sidewalls 56 and a transverse wall 58 extending between and integrally connecting the two sidewalls 56. The three body walls 56, 58 generally bound or define an open hollow space $S_C$ into which extends a portion of a connective member 71 of the electric actuator 18, as discussed in further detail below. Further, each sidewall 56 has a generally triangular front section 55*a* and the transverse wall 58 has an angled front section 58*a*, the connected front sections 56*a* and 58*a* of the three walls 56, 58 forming the wedge-shaped portion 52.

Preferably, the wedge-shaped portion 52 of the cam body 50 includes a generally rectangular locking projection 60 extending along a free edge 59 of the transverse body wall 58 and having an edge surface section 62 providing the camming surface 19. The camming edge surface 62 is contactable with the clutch contact surface 13 such that when the cam 16 displaces along the cam axis 17 in a first direction $D_1$, generally toward the assembly axis 11, the camming edge surface 62 slides against the clutch contact surface 13 so as to displace the clutch 12 from the first clutch position $C_1$ to the second clutch position $C_2$, as discussed in greater detail below. Further, the locking projection 60 is disposeable within the locking recess 42 of the clutch 12 so as to thereby retain the clutch 12 disposed in the second clutch position $C_2$, as depicted in FIGS. 3 and 8. Specifically, the locking projection 60 has a transverse locking surface 64 that abuts the radial stop surface 41 of the clutch conical portion 40 to prevent displacement of the clutch 12 in the second axial direction $A_2$. Furthermore, the cam 16 has at least one and preferably three openings 61 extending through a central portion of the transverse wall 58 and a connector pin 63 extending through one of the openings 61, which is used to couple the cam 16 with the actuator 18 (see, e.g., FIG. 3), as described below.

Figure 12:
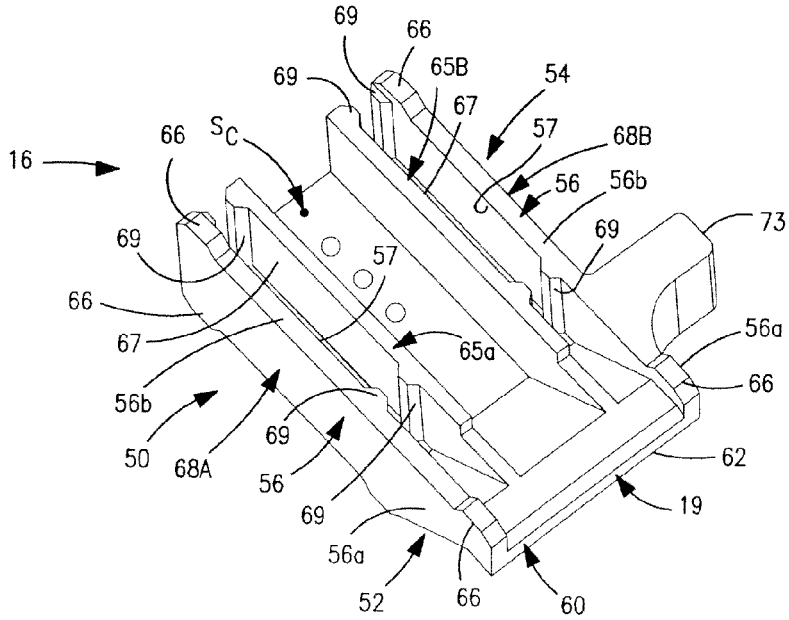
FIG. 12 is a bottom perspective view of the preferred cam.

Preferably, the cam 16 further includes a plurality of slide lugs 66 extending outwardly from opposing sides of the body 50, such that the lugs 66 and the sidewalls 56 form two spaced-apart slide rails 68A, 68B. More specifically, two lugs 66 extend outwardly from the free edge 56*b* of each sidewall 56 and another two lugs 66 extend from the opposing edge 56*b* (connected with the transverse wall 58) of each sidewall 56. Each slide rail 68A, 68B is sized to fit between two facing bearing wall surfaces 101A, 101B of a lockset housing 100, as described below, such that two lugs 68 of each rail 68A, 68B slidably contact each surface 101A or 101B, as best shown in FIGS. 3 and 4. With this arrangement, when the cam 16 displaces along the second or cam axis 17, the lugs 66 slide against the bearing surfaces 101A, 101B to restrict the movement of the cam 16, and particularly the camming surface 19, to displace substantially perpendicularly, and not axially, with respect to the assembly axis 11. Referring particularly to FIG. 12, the cam 16 preferably further includes a pair of inner retainer walls 65 each spaced inwardly from and extending generally parallel with respect to a separate one of the two sidewalls 56. Each side wall 56 and associated retainer wall 65 includes a pair of slide bars 69 extending from facing surfaces 57, 67 of each wall 56, 65, respectively. When the cam 16 is disposed within the housing 100, each proximal pair of walls 56 and 65 are disposed on opposing sides of one of two guide walls 103 (see FIG. 6) of the housing 100, such that each guide wall 103 is sandwiched between the associated pair of walls 56 and 65. With this structure, when the cam 16 displaces along the cam axis 17, the bars 69 slide along the wall outer surfaces 103*a* such that the slide bars 69 and the guide walls 103 interact to further restrain the displacement of the cam 16 to be generally perpendicular with respect to the assembly axis 11.

As a result of the restricted displacement of the cam 16 and the angled configuration of the clutch contact surface 13, sliding contact between the camming surface 19 and the clutch surface 13 forces the clutch 12 to displace laterally along the assembly axis 11, specifically in the first direction $A_1$ due to the orientation of the contact surface 13 facing generally in the second direction $A_2$. Thus, the cam 16 and the clutch 18 interact generally in the manner of a cam-slider arrangement as known in the mechanical arts, such as the machine tool industry (e.g., tool and die cam slides).

Furthermore, the cam 16 preferably further includes a connective arm 73 extending laterally outwardly from one side wall 56. The connective arm 73 is configured to connect the cam 16 with a fastener shield device 150, as described below, preferably by means of a spring shaft 172. Specifically, one end 172*a* of the spring shaft 172 is attached to the connective arm 73 such that when the cam 16 displaces along the cam axis 17, the spring shaft 172 pulls or pushes the shield device 150 to displace between first and second positions, as described in detail below.

Although the clutch assembly 10 preferably includes a cam 16 as described above, the clutch assembly 10 of the present invention may alternatively be constructed in any other appropriate manner that is capable of linearly displacing the clutch 12 between the first and second clutch positions $C_1$, $C_2$. For example, the mechanism 15 may be provided by a linkage (not shown) having a first end attached to the clutch 12 and a second end attached to an actuator device, such as a motor, a solenoid or even a hydraulic piston (not preferred), such that the linkage positively displaces the clutch 12 between both clutch positions $C_1$ and $C_2$. The scope of the present invention includes these and all appropriate structures of the mechanism 15 capable of displacing the clutch 12 in the manner generally described herein.

Referring now to FIGS. 3, 5, 6, 14 and 15, the electric actuator 18 is preferably an electric motor 70 having a rotatable shaft 72 operatively connected with the cam 16. As such, rotation of the shaft 72 in a first direction $R_1$ (FIG. 6) displaces the cam 16 generally toward the first, assembly axis 11 and rotation of the shaft 72 in a second direction $R_2$ displaces the cam 16 generally away from the assembly axis 11. The actuator 18 preferably further includes a connective member 71, preferably a spring shaft 74 having a first portion 74*a* connected with the rotatable shaft 72 and a second portion 74*b* connected with the cam body 50. More specifically, an adapter 76 is attached to the free end 72*a* of the motor shaft 72 and has a radially-enlarged portion 76*a* about which the spring shaft first portion 74*a* is fixedly mounted. The spring shaft second portion 74*b* is disposed within the interior space $S_C$ of the cam body 50 and the connector pin 63 extends through a midsection of the spring shaft 74, so as to be disposed between adjacent coils of the shaft 74. With this structure, rotation of the motor shaft 72 rotates or angularly displaces the spring shaft 74, such that the spring 74 pushes or pulls (depending on the direction of rotation) the connector pin 63 to travel along the helical spring coils, thereby linearly displacing the cam 16 along the cam axis 17. Further, the motor 70 is electrically connected with an electrical power supply (not shown), such as a battery.

Preferably, the actuator connective member 71 further includes a coupler pin 75 attached to an end 74*c* of the spring shaft 74 and configured to slidably couple the spring shaft 74 with the base 100. More specifically, the base 100 has a transverse base wall 105 extending between the guide walls 103 which has a slotted opening 105*a* and the coupler pin 75 has a shaft portion 75*a* that extends through the opening 105*a*, such that the pin 75 both couples the shaft 74 to the base 100 and guides the displacement of the shaft 74. Although the spring shaft 74 is preferred, the connective member 71 of the actuator 18 may alternatively be a threaded rod engaged with a threaded opening in the cam 16, a pinion gear engaged with a rack gear connected with the cam 16, or any other appropriate component enabling motor rotation to cause linear displacement of the cam 16. As another alternative, the actuator 18 may be another type of electric actuator, such as a solenoid, or even a different type of actuator, such as a hydraulic motor (not preferred). The scope of the present invention includes the actuator structures discussed herein and all other appropriate actuator structures capable of displacing the cam 16 to effect displacement of the clutch 12 along the assembly axis 11.

Figure 2:
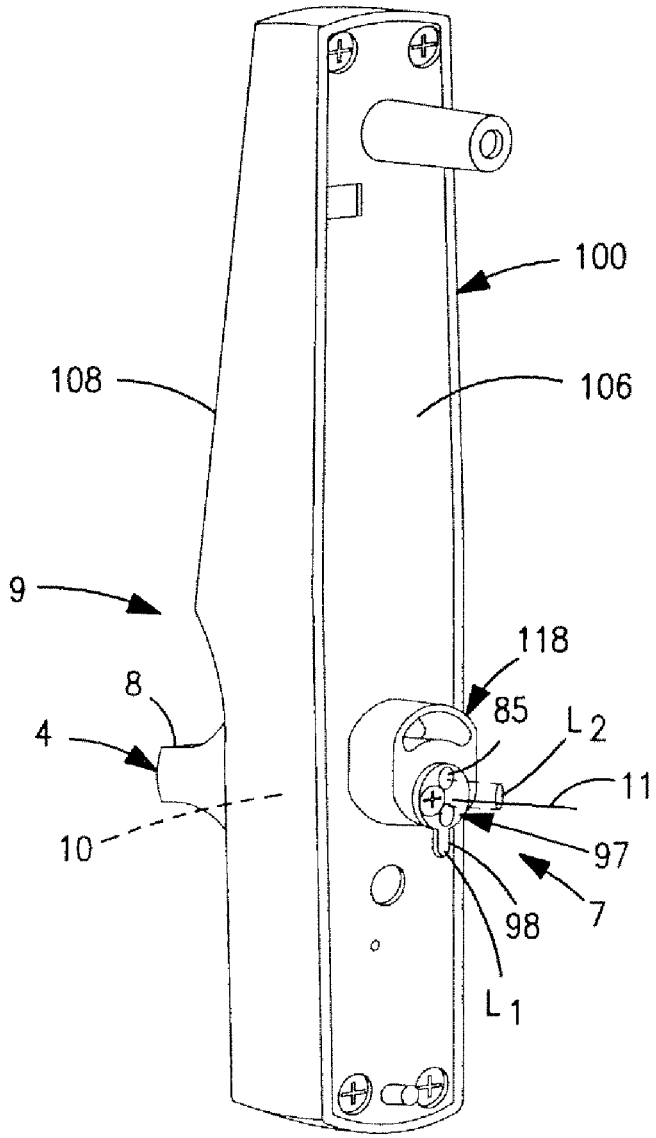
FIG. 2 is a rear perspective view of a preferred lock actuator assembly that includes the clutch assembly.

Referring to FIGS. 3-5, 7, 8 and 13, the preferred structures of the two actuator spindles 3 and 4 are each now described. The first or output spindle 3 is preferably formed as a generally circular cylindrical body 80 having a central longitudinal axis 81 and a rectangular-shaped opening or bore 82 extending axially from an inner end 80*a* of the body 80. The rectangular bore 82 is sized to fit about the clutch end shaft portion 34 so as to permit relative axial displacement of the clutch 12 while preventing relative rotational displacement thereof, as discussed above. Further, the output spindle 3 preferably includes a circumferential outer surface 83 and an annular retainer groove 84 extending into the body 80 from the outer surface 83 and circumferentially about the axis 81, the purpose of which is described below. As best shown in FIG. 2, the spindle body 80 further includes a rectangular projection 85 extending from the body outer end 80*b* and configured to fit within a mating opening of the output cam 7. The preferred cam 7 is preferably removably retained on the output spindle 3 by means of a threaded fastener (see FIG. 2). However, the output spindle 3 may be formed in any other appropriate manner so as to interact with the specific structure of the output cam 7, several alternative cam structures being depicted in FIG. 19

Figure 13:
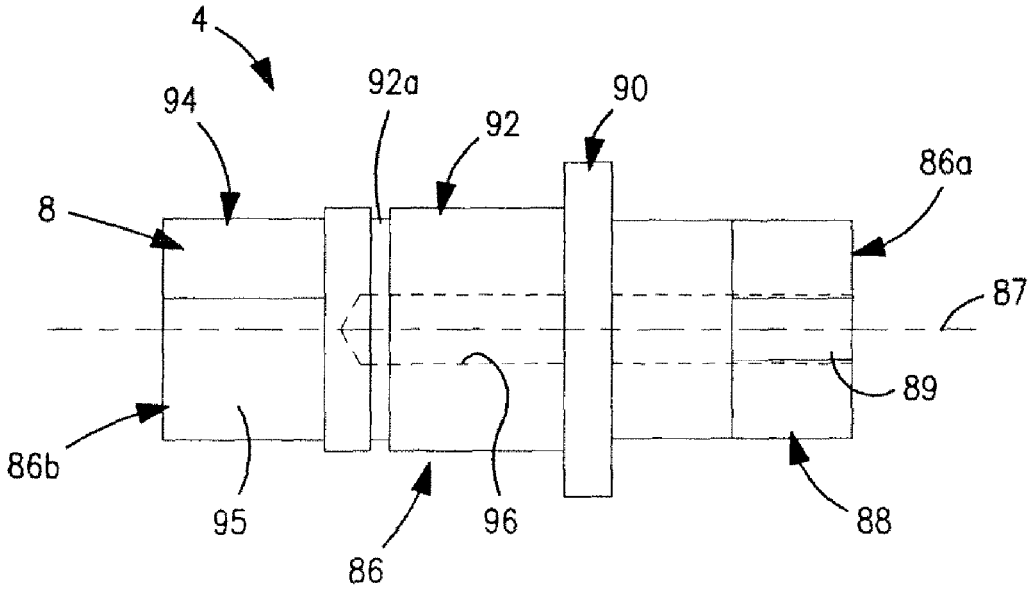
FIG. 13 is a side plan view of a preferred input spindle.
Figure 14:
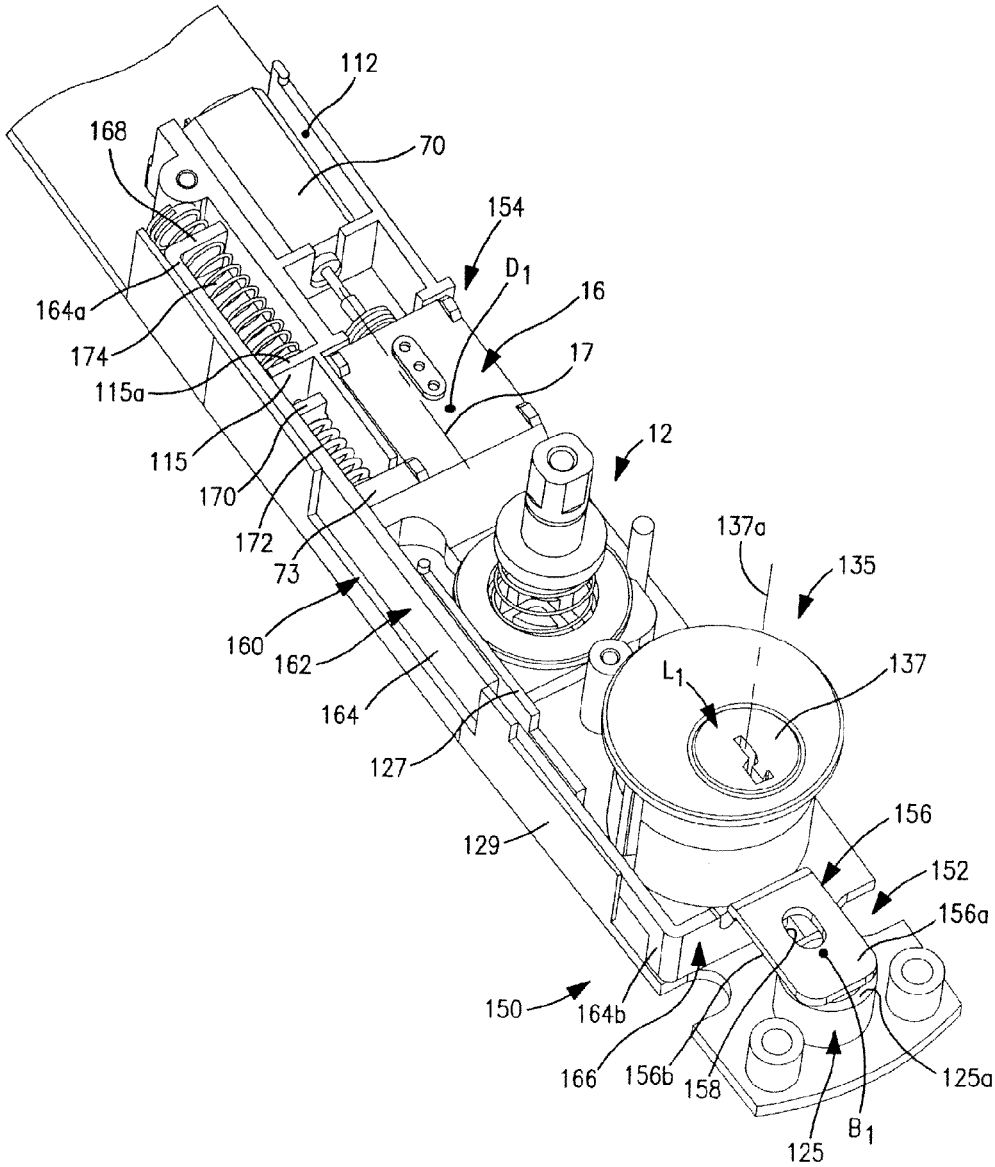
FIG. 14 is a broken-away, perspective view of the clutch mechanism, shown with the cam and a fastener shield each in a first position.
Figure 15:
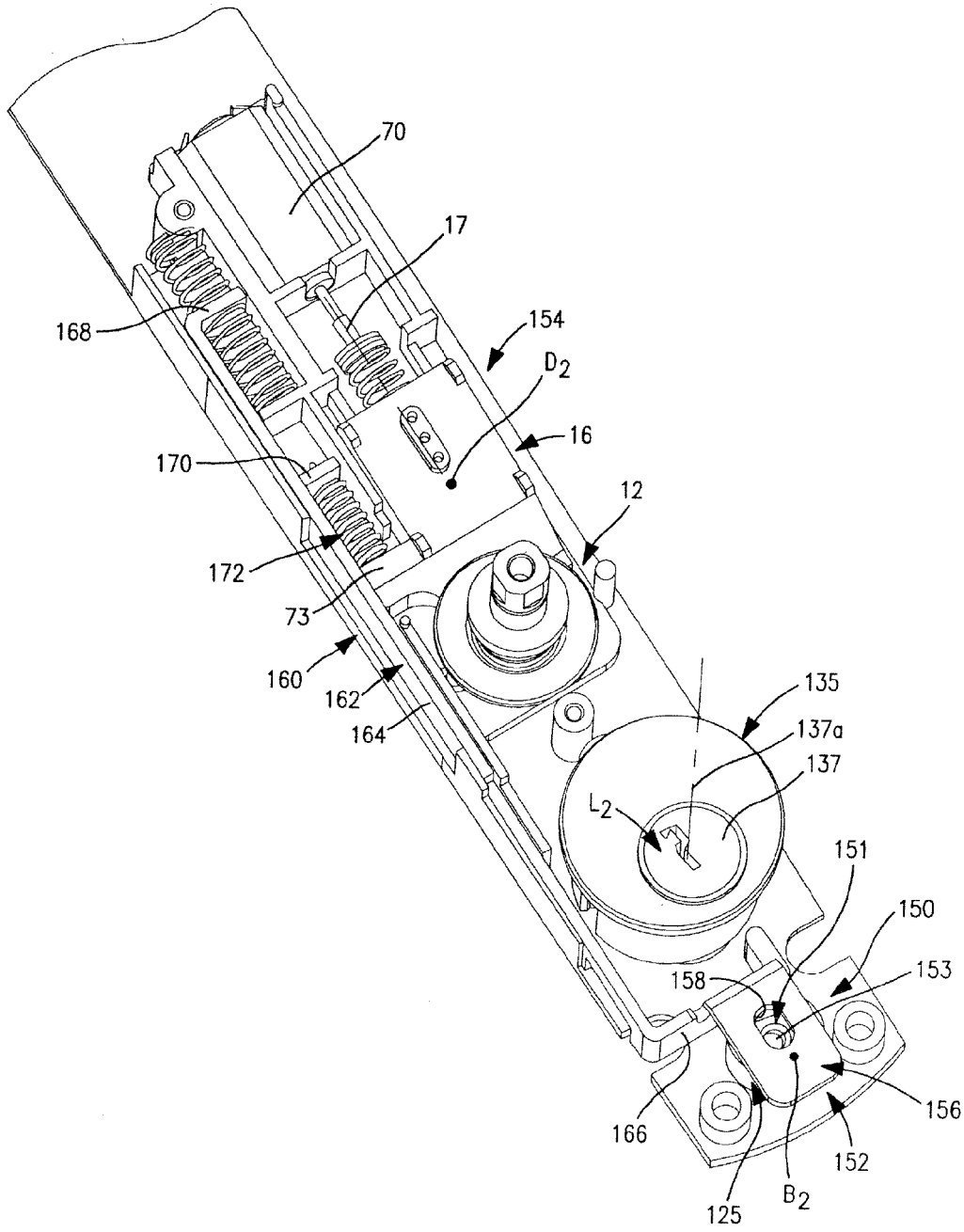
FIG. 15 is another broken-away, perspective view of the clutch mechanism, shown with the cam and the fastener shield each in a second position.

As best shown in FIG. 13, the second or input spindle 4 is preferably formed as a complex-shaped cylindrical body 86 having a longitudinal central axis 87, which is collinear with the assembly axis 11 when the spindle 4 is installed in the lock actuator assembly 9. The second spindle body 86 has a first or inner end 86*a* engageable with the clutch 12 and a second or outer end 86*b* providing the handle portion 8. Preferably, the body 86 includes a cross-shaped end shaft portion 88 at the inner end 86*a*, an annular retainer shoulder 90, a circular intermediate shaft portion 92 and a generally rectangular end shaft portion 94 at the outer end 86*b*. The end shaft portion 88 is generally cross-shaped and has four generally rectangular sections 89 each extending radially from a common center on the body axis 87. Each shaft section 89 is sized to fit between a separate pair of adjacent rectangular lugs 45 that are disposed within the clutch opening 44 (see FIG. 5) so as to rotatably couple the second, input spindle 4 with the clutch 12, and thus also with the first, output spindle 3, as discussed above and in further detail below.

As best shown in FIG. 4, the retainer shoulder portion 90 is sized radially larger than a pair of aligned openings 134 and 146, one in the actuator assembly housing 100 and the other in an inner retainer plate 144 (as described below), so as to generally prevent axial displacement of the input spindle 4 along the assembly axis 11. Further, the intermediate shaft portion 92 is shaped as a generally circular cylinder and is sized to fit within a journal bearing 136 of the housing 100, the bearing 136 rotatably supporting the spindle 4, as discussed below, and includes an outer circumferential annular groove 92*a*. Furthermore, the rectangular handle portion 94 has two pairs of flats 95 onto which an outer knob 8*a* (FIG. 1) is retained by a friction fit, although any other appropriate outer handle (e.g., a lever) may be provided. In addition, the second spindle body 86 preferably has a generally circular central bore 96 extending inwardly from the body inner end 86*a* and along the body axis 87, the bore 96 being sized to receive the free end 32*b* of the clutch guide rod 32, as described above.

Although the electronic clutch mechanism 10 of the present invention is preferably used with first and second spindles 3, 4, respectively, formed as described above, the clutch mechanism 10 may alternatively be used with two spindles 3 and 4 formed in any other appropriate manner. For example, the clutch 12 may alternatively be configured so as to be coupled with the second, input spindle 4 and having a connective portion 14 releasably engageable with the first, output spindle 3. As the present invention is directed primarily to the electronic clutch mechanism 10, the scope of the present invention is not limited to being used with any specific first and second spindles 3, 4.

Referring to FIGS. 1-4, 7 and 8, as discussed above, the electronic clutch mechanism 10 and the two spindles 3 and 4 are preferably incorporated into a lock actuator assembly 9 of a lock system 1. The actuator assembly 9 is configured to permit selective coupling and uncoupling of the handle 8 with the output cam 7 to respectively enable and disable operation of the lockset 6, as discussed above and in further detail below. The actuator assembly 9 includes the output cam 7, which is preferably a plate cam 97 fastened to the outer end 3*b* of the output spindle 3 and having a lever arm 98 engageable with a latch bolt (not shown) of the lockset 6. When the output spindle 3 is rotated about the assembly axis 11, the lever arm 98 displaces between a first position $L_1$ and a second position $L_2$ (see FIG. 2), such that the lever arm 98 causes the latch bolt (not depicted) to move the latch 5 between the locked and unlocked positions, and vice-versa. Alternatively, the output cam 7 may be formed in any other appropriate manner, such as a cross shaped key configured to engage with push bar latch (FIGS. 19 and 20A), as a cam plate with two lever arms 98 (FIG. 20B), as a hook plate (FIG. 20C), as a pivotable roller cam assembly (FIG. 20D), etc. Due to the present invention being directed primarily to the electronic clutch mechanism 10, as discussed above, the scope of the present invention is not limited to use with any particular type of cam 7, latch 5 or lock system 1.

Referring to FIGS. 3-8, 14 and 15, the actuator assembly 9 also includes a housing 100 configured to contain and support the various components of the clutch assembly 10 and certain other components of the assembly 9. The housing 100 is generally rectangular and has first and second openings 102, 104, respectively and an interior space $S_H$. The first, output spindle 3 is rotatably disposed within the first housing opening 102, the second, output spindle 4 is rotatably disposed within the second housing opening 104, and the clutch 12, the cam 16 and the actuator 18 are each disposed within the interior space $S_H$. More specifically, the housing 100 is preferably formed of an elongated rectangular base plate 106 and a generally rectangular shell 108 attached to the base plate 106 so as to define the interior space $S_H$. The base plate 106 has an inner surface 107 and a plurality of integrally-formed structural walls 110 extending outwardly from the inner surface 107, the structural walls 110 defining a first compartment 112 for the electric actuator 18, which is sized to receive the motor 70, and a longitudinal outer guide wall 114 for generally guiding or restraining the displacement of the cam 16. As discussed above, the housing 100 includes the pair of spaced-apart longitudinal inner guide walls 103, which extend from the base plate inner surface 107 and parallel with the guide wall 114, and the transverse wall 105. The inner guide walls 103 function to further restrain or guide the displacement of the cam 16 along the cam axis 17 and the four walls 103, 105 and 110 form a second actuator compartment 113 inside of which the spring shaft 74 is disposed. Further, a spring retainer plate 115 extends laterally outwardly from the outer guide wall 114 and provides a surface 115*a* against which is disposeable one end of a return spring 174 of the fastener shield device 150, as discussed below. Furthermore, a plurality of integral attachment posts 116 extend from the inner surface 107 and are used to assemble certain lockset components into the housing 100, as discussed below.

In addition, the base plate 106 also has an outer surface 117 and preferably further includes an integrally-formed output block 118 extending outwardly from the outer surface 117. The output block 118 has a through-bore 120 configured to rotatably support the first spindle 3, a pin hole 122 extending through the block 118 transversely to the bore 120 so as to intersect one side 120*a* thereof, and an arcuate slotted opening 124 for connecting with a portion (not shown) of the lockset 6. When the first spindle 3 is disposed in the output block bore 120, a lockpin 126 is inserted into the pin hole 122 such that a portion of the pin 126 becomes disposed within the spindle retainer groove 84, thereby permitting rotation of the spindle 3 but preventing axial displacement thereof. Further, the base plate 106 also preferably includes at least one and preferably two (see FIG. 16) generally cylindrical fastener blocks 125 each extending from the base inner surface 107 and having a counterbore opening (not indicated) configured to receive a fastener 151, as discussed below. Furthermore, the base plate 106 preferably further includes inner and outer longitudinal retainer walls 127, 129 extending from the inner surface 107, which function to slidably retain a link 160 of the shield device 150, as described below.

Referring to FIGS. 1, 3, 4 and 19, the rectangular shell 108 of the housing 100 preferably has an input block 130 extending from an inner surface 109, a control panel 132 configured to mount the input device 22 of the lock system 1 and a supplemental block 133 for mounting a mechanical "back-up" lock actuator 135 (discussed below). The input block 130 has a circular central through-bore 134 sized to receive a bushing 136 that functions as a journal bearing for the second, input spindle 4. The bore 134 has an inner counterbore section 134*a* sized to receive the head 136*a* of the bushing 136 and an outer counterbore section 134*b* sized to receive an annular washer 138. A circular clip 140 is installed into the outer groove 92*a* of the second spindle 4 so as to prevent axial displacement of the second spindle 4 in the second direction $A_2$ along the assembly axis 11. Further, the input device 22 is preferably a key pad 23 attached to the control panel 132 of the housing shell 108, but may alternatively be any other appropriate type of input device, such as a card reader, a finger print or retinal scanner, etc. As best shown in FIG. 17, the housing shell 108 preferably further includes at least one and preferably two fastener access openings 131 (only one shown) each located with respect to one of the fastener blocks 125 so as to be generally aligned with the head 153 of the associated fastener 151, such that the head 153 may be generally accessible through the opening 131, depending on the arrangement of the shield device 150, as described below.

Furthermore, the lock actuator assembly 9 also includes a generally flat retainer plate 140 removably mounted to the attachment posts 116 of the base plate 106 and having an opening 142 through which extends portions of the second spindle 4 and the spring 48. The retainer plate 140 also has an inner surface 141 providing one slide bearing wall surface 101A, the other bearing surface 101A being provided by a facing section of the base plate inner surface 107, such that the cam 16 is slidably retained between the retainer and base plates 140, 106, respectively. The retainer plate 140 also functions to removably retain the electric actuator 18 disposed within the first compartment 112. Furthermore, the actuator assembly 9 preferably further includes a generally bell-shaped retainer plate 144 disposed against an outer surface 143 of the flat retainer plate 140 and having an opening 146 generally aligned with the retainer plate opening 142. The bell-shaped retainer plate 144 has an inner radial surface 148 facing generally toward the clutch inner radial surface 47, such that the spring 48 is generally compressed between the two surfaces 148 and 47, as discussed above.

In addition, the lock actuator assembly 9 also preferably includes a supplemental mechanical lock actuator 135 (mentioned above) which is operatively coupled or connected with the lockset 6, most preferably by means of the fastener shield device 150 as described below. The supplemental lock actuator 135 is preferably a key-operated cylinder lock including a lock cylinder 137 rotatable about a central axis 137*a* and an output cam 139 operably coupled with the cylinder 137. The cylinder 137 is configured to receive a key (not shown) such that when the key is inserted into the cylinder 137 and manually rotated or turned, the cylinder 137 rotates about the axis 137*a* so as to displace the cam 139. More specifically, the cylinder 137 is rotatable between a first position $L_1$ (see FIG. 17A) and a second position $L_2$ (see FIG. 17B), which causes the output cam 139 to displace radially outwardly (and alternatively radially inwardly) with respect the axis 137*a*. The outward displacement of the cam 137 preferably actuates the fastener shield device 150 such that the shield device 150 causes the clutch 12 to displace to the second clutch position $C_2$, as described below, thereby coupling the first and second spindles 3 and 4 as discussed above. Alternatively, the output cam 139 (or other portion of the supplemental actuator 135) may be directly connected with the cam 16, such as by a link or linkage (not shown) as opposed to being connected through the shield device 150. In either case, the supplemental lock actuator 135 provides a "mechanical override" in case of a failure of the electronic clutch assembly 10.

Referring to FIGS. 5, 6 and 14-18, as mentioned above, the lock system 1 preferably further includes a fastener shield device 150 that is configured to prevent access to one or more fasteners 151 used to connect or mount the actuator assembly 9, specifically the housing 100, to a door 2 or a door frame (not depicted). The shield device 150 basically comprises at least one and preferably two movable barriers 152 (see FIG. 16) and displacement means 154 for displacing the barriers 152 in basically in the following manner. The barriers 152 are each preferably movably disposed within the housing 100 and are displaceable between a first position $B_1$ (FIGS. 5, 14, 17A and 18A), at which each barrier 152 at least partially covers a proximal fastener 151 so as to prevent removal of the fastener 151 from the door 2, and a second position $B_2$ (FIGS. 15, 16, 17B and 18B) at which the fasteners 151 are generally accessible, i.e., so as to permit removal of each fastener 151 from the door 2. More specifically, each fastener 151 extends through one of the fastener blocks 125 and into the door 2 or doorway and has a head 153 that is engageable by a tool, such as a screw driver, an Allen wrench, etc. (none shown), each barrier 152 being configured to prevent engagement of the tool with the head 153 of the proximal fastener 151 when the barrier 152 is located in the first position $B_1$. With the preferred housing structure as described above, each barrier 152 is disposed generally between the proximal fastener access opening 131 of the housing 100 and the fastener head 153 in the first position $B_1$, as best shown in FIG. 17A, so as to generally prevent insertion of the tool through the housing opening 131. It must be noted that, in FIGS. 14, 15 and 18, the barrier first and second positions $B_1$ and $B_2$ are indicated by reference to the approximate geometric center of the barrier 152 for convenience only and any other point on the barrier 152 may alternatively be used.

Preferably, each barrier 152 is disposed in the first position $B_1$ when the lock system 1 is arranged in an inoperable state, specifically when the input spindle 4 is not coupled with the output spindle 3 such that the latch 5 cannot be displaced (i.e. "unlocked"). In addition, the barrier(s) 152 are preferably disposed in the second position $B_2$ when the lock system 1 is arranged in an operable state, i.e., the two spindles 3 and 4 are coupled such that rotation of the handle 8 causes the latch 5 to displace between the locked and unlocked positions. As such, the fastener shield device 150 basically functions to prevent unauthorized removal of the fastener(s) 151, and thereby the entire lock actuator assembly 9, from the door 2 or doorway since the preferred logic circuit 24 must be properly activated in order to remove the fasteners 151, as discussed above and in further detail below. However, as the fastener shield 150 is preferably also actuatable by means of the supplemental lock actuator 135, as discussed above and in further detail below, the fasteners 151 may be accessed by an authorized user having the correct key (not shown) for the preferred cylinder lock 137, even when there is a failure of the logic circuit 24 or other electrical component of the clutch assembly 10. Furthermore, the shield device 150 may alternatively be constructed so as to be separate from or unconnected with the clutch assembly 10, as discussed below, such that the device 150 may permit access to the fasteners 151 when the lock system 1 is arranged in the inoperable state and/or prevent access to the fasteners 151 when the lock system 1 is disposed in the operable state.

Preferably, each barrier 152 is formed as a generally rectangular plate 156 having opposing first and second surfaces 156*a*, 156*b*, respectively, and may include an access opening 158 extending between the two surfaces 156*a*, 156*b*. The access opening(s) 158 (only one depicted) are each sized to permit the tool to pass or extend therethrough and is located on the particular barrier 152 so as to be generally aligned with the proximal fastener head 151 when the barrier 152 is located in the second barrier position $B_2$. In addition, the access opening(s) 158 are generally aligned with the fastener access opening 131 of the housing 100 when the associated barrier 152 is located in the second position $B_2$, so as to thereby enable insertion of a tool into the housing 100 and through the barrier 152 to engage with the fastener head 153. Alternatively, the one or more barrier plates 156 may each be formed without the access opening and sized or located such that the barrier 152 is spaced from the proximal fastener 151 in the second position $B_2$ so that the plate 156 does not extend over the fastener head 153, as depicted in the upper, left section of FIG. 16. Preferably, each barrier plate 156 is generally disposed upon the associated fastener block 125, such that the plate second surface 156*b* slides against the outer radial surface 125*a* of the block 125, although the plate 156 may alternatively be spaced from the block surface 125*a*. For example, the barrier first surface 156*a* may be disposed generally against the housing shell inner surface 109 so as to extend across and obstruct the fastener access opening 131 in the first position $B_1$ and such that the access opening 158 is generally aligned with the housing opening 131 in the second position $B_2$ (not shown).

Further, the shield device 150 preferably further comprises a link 160 having a first end 160*a* connected with a movable member of the lock actuator 9, most preferably the cam 16, and at least one second end 160*b* connected with the one or more barriers 152. As such, the cam 16 and the link 160 provide displacement means 154 for the barrier 152; in other words, movement of the cam 16 displaces the link 160 such that the link 160 displaces the barrier(s) 152. Preferably, the link 160 includes an elongated body 162 having a generally longitudinal main body section 164, a lateral retainer section 168 extending from a first end 164*a* (FIGS. 14 and 15) or a middle portion 164*a*' (FIG. 16) of the body main section 164, and at least one lateral connective section 166 extending between a second end 164*b* of the main section 164 and one barrier plate 156. Further, an attachment tab 170 is connected to the body main section 164 and is configured to attach the spring shaft 172 with the link 160, such that the link 160 is connected with the cam 16 through the spring shaft 172. As such, when the cam 16 displaces along the cam axis 17 between the first, nonengaged position $D_1$ (FIG. 14) and the second, engaged position $D_2$ (FIG. 15), the spring shaft 172 pulls the link 160 such that the link 160 displaces the barrier (s) 152 between the first and second barrier positions $B_1$, $B_2$, respectively.

Furthermore, the fastener shield device 150 preferably further includes a return spring 174 extending generally between the spring retainer plate 115 of the housing 100 and the link retainer section 168, the retainer section 168 preferably being disposed between adjacent coils of the spring 174. With this structure, the return spring 174 is configured to assist the "return" displacement of the link 160 when the cam 16 displaces from the second position $A_2$ to the first position $A_1$, and thereby assists the movement of the barrier(s) 152 from the second position $B_2$ to the first position $B_1$. However, the one or more barriers 152 may be returned to the first position $B_1$ solely by means of the displacement of the cam 16 toward the first position $A_1$, as the spring shaft 170 will "push" the link 160 to thereby displace the barrier(s) 152.

Figure 16:
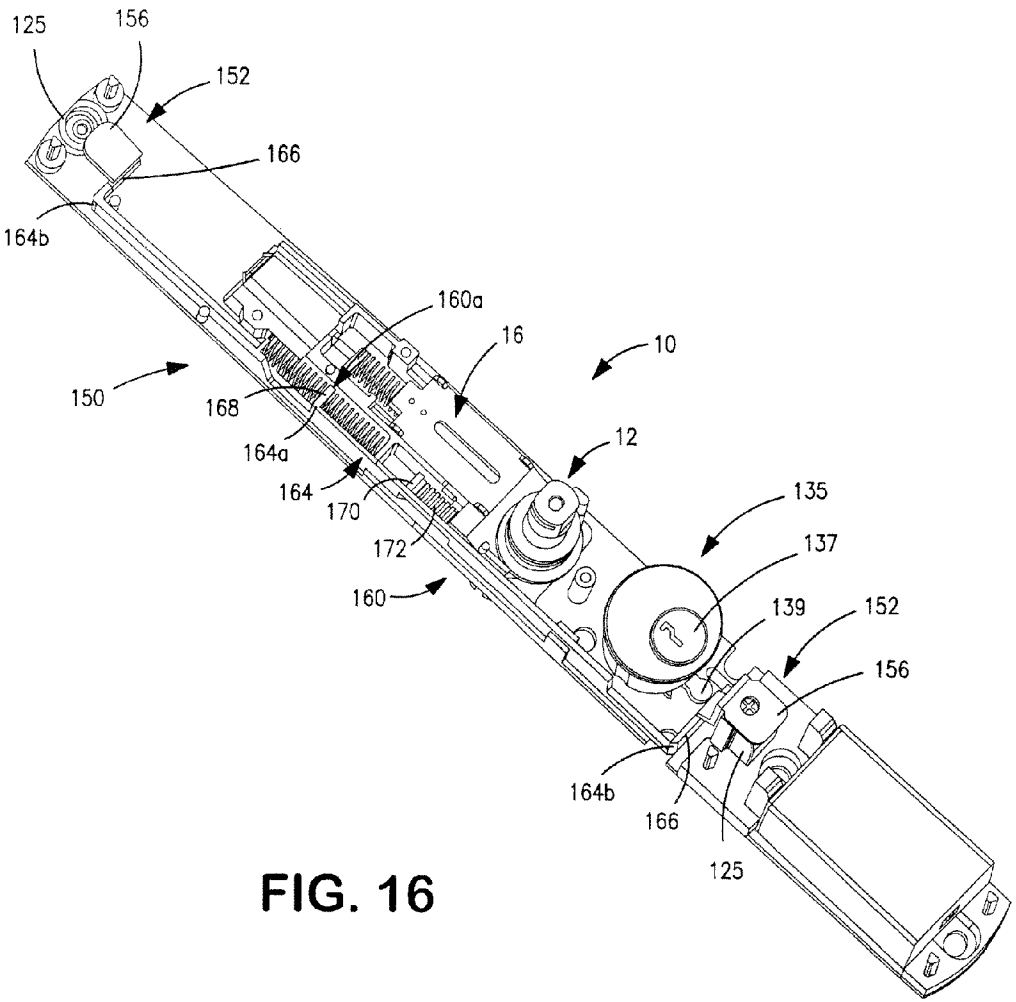
FIG. 16 is another broken-away, perspective view of the clutch mechanism, shown with an alternative construction of the shield device, located in the second position.
Figure 17A:
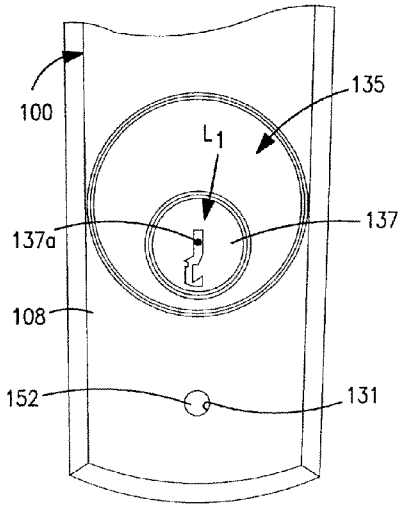
FIGS. 17A and 17B, collectively
Figure 17B:
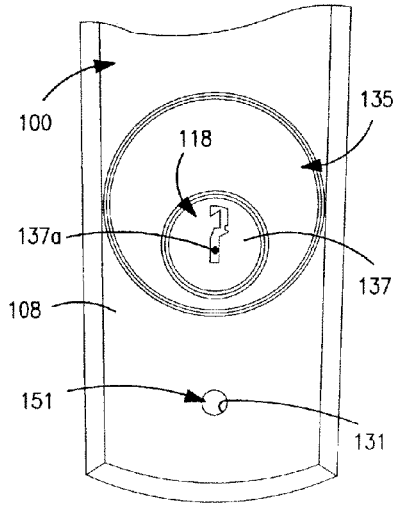
Figure 18A:
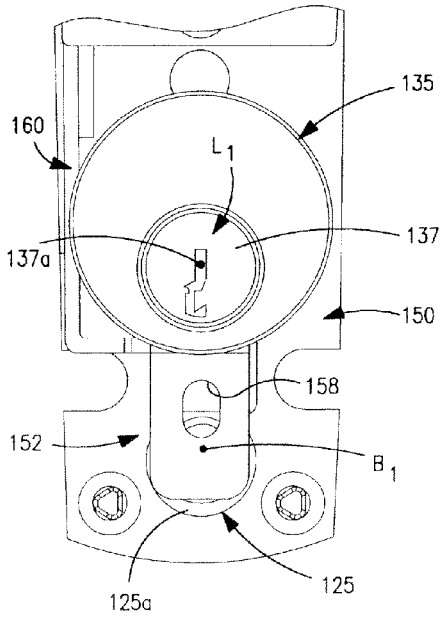
FIGS. 18A and 18B, collectively
Figure 18B:
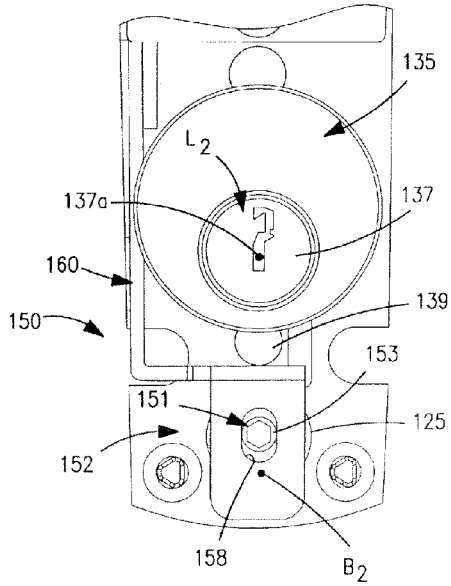

Referring to FIGS. 16, 18A and 18B, the link 160 is preferably operably connected or coupled with the output cam 139 of the manual lock actuator 135, such that the link 160 also functions to displace the cam 16 into engagement with the clutch 12. More specifically, the output cam 139 is contactable with the link 160 such that when the cam 139 is linearly displaced by rotation of the lock cylinder 137, as discussed above, the cam 139 pushes the link 160 so that the link 160 pulls the cam 16 into engagement with the clutch 12, to thereby cause the clutch 12 to couple the output and input spindles 3 and 4, respectively. Simultaneously, such movement of the cam 139 of the manual lock actuator 135 also displaces the barrier(s) 152 between the first and second barrier positions $B_1$, $B_2$, respectively, thereby exposing the fastener(s) 151 for potential removal. Thus, the supplemental lock actuator 135 preferably functions both to permit the lock system 1 to be operated and to provide access to the fastener (s) 151 in the event of a failure of the electronic components of the clutch assembly 10, such as the motor 70, the electric power supply (not shown) or the logic circuit 24. However, the shield device 150 may alternatively be operated by means of a separate actuator (not shown), such as a motor connected with the link 160, and/or the supplemental actuator 135 may alternatively be directly connected with the cam 16 or even the clutch 12 by any other appropriate means. As a further alternative, the link 160 of the fastener shield 150 may be constructed without the attachment tab 170 or other means for connecting the link 160 with the cam 16. Such a fastener shield 150 is actuated solely by means of the supplemental lock actuator 135, or any other appropriate actuator, and not by operation of the clutch assembly 10 (i.e., displacement of the cam 16), with the lock actuator 135 being connected to the clutch assembly 10 by another appropriate device (e.g., a separate link).

Figure 19:
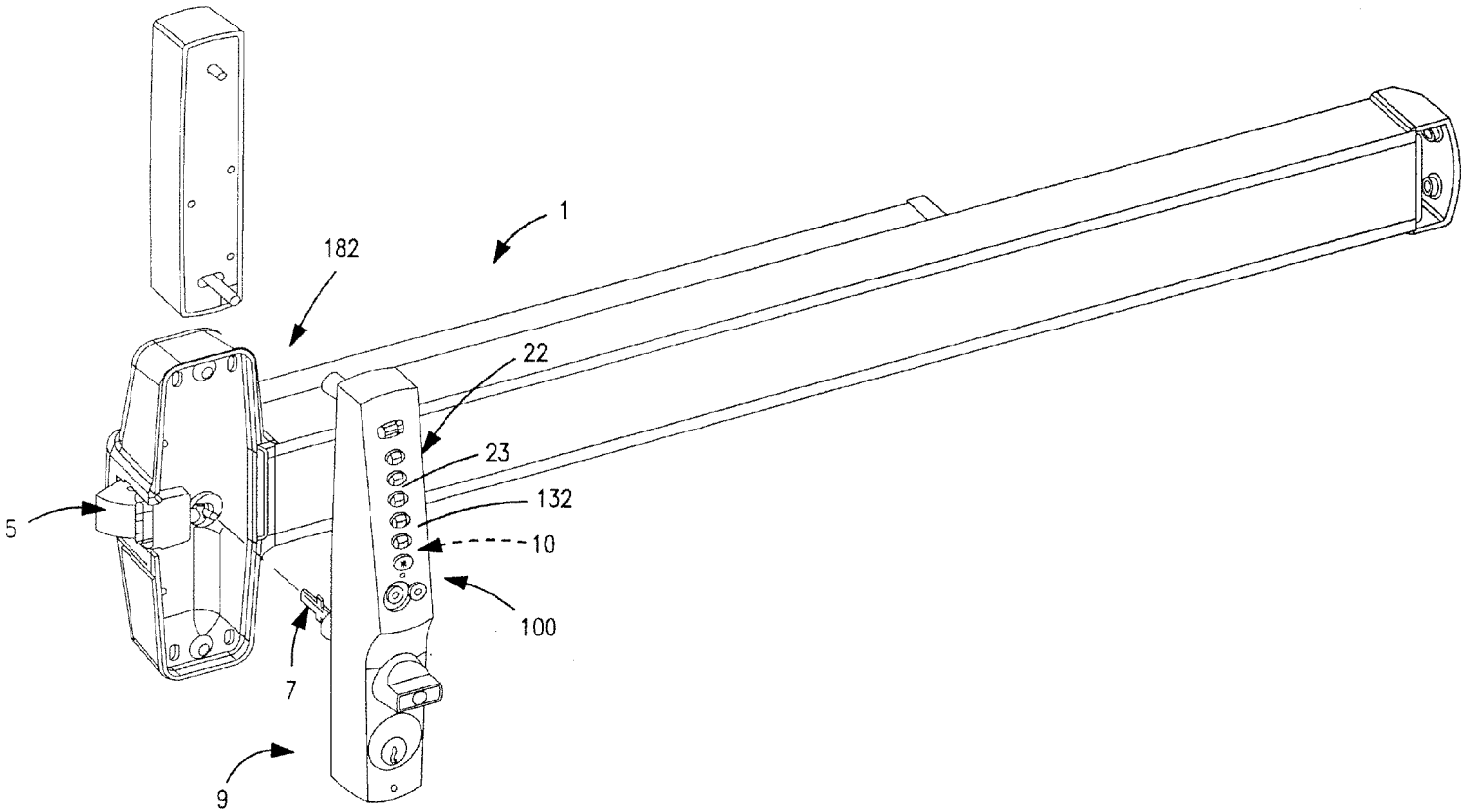
FIG. 19 is a front perspective view of an alternative application of the lock system incorporating the electronic clutch assembly.
Figure 20A:
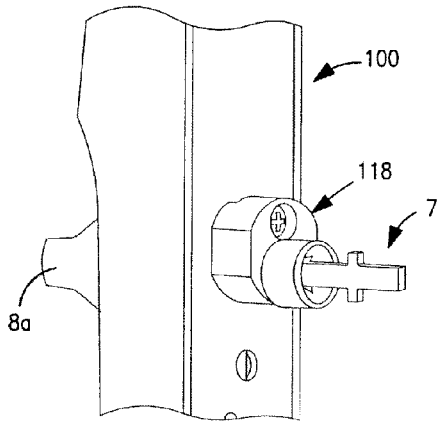
FIGS. 20A-20D, collectively
Figure 20B:
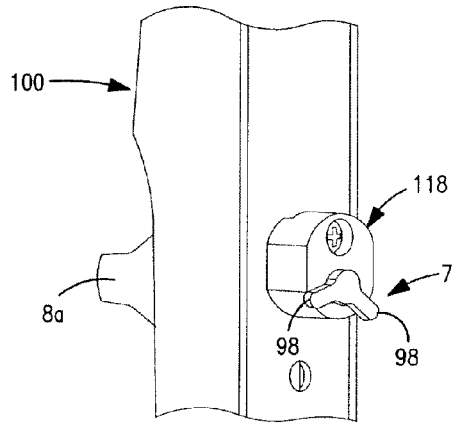
Figure 20C:
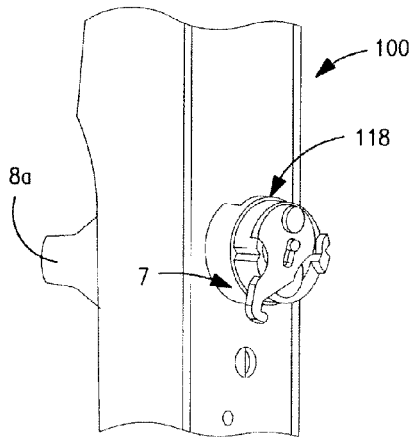
Figure 20D:
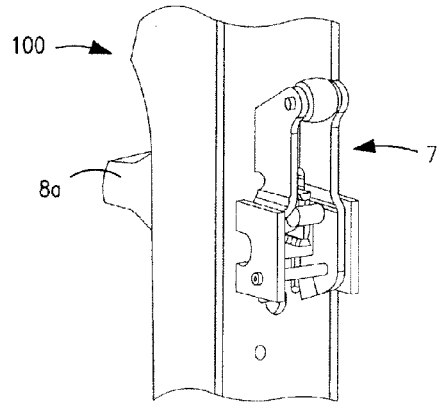

Referring now to FIG. 1, the electronic clutch assembly 10 of the present invention is preferably used with a conventional lockset 6, most preferably a mortise lockset 162 mounted within the door 2. The preferred lockset 180 has a latch bolt (not shown) operably coupled with the output cam 7 such that rotation of the output spindle 3 of the lock actuator assembly 9 displaces the latch bolt to move the latch 5 between the locked and unlocked positions. Although a mortise lockset 162 is preferred, the clutch assembly 10 and the actuator assembly 9 may be used with any other appropriate type of lockset 6, such as for example, a push bar assembly 182 as shown in FIG. 19. Further, the lock system 1 also preferably includes a control module 164 having a housing 166 connectable with an inner surface of the door 2 and containing the logic circuit 24. The logic circuit 24 is preferably configured to generate a first control signal in response to an appropriate input signal from the input device 22, such as generated by a user pushing a specific sequence of buttons on the preferred key pad 23, such that the electric actuator 18 displaces the cam 16 in the first direction $D_1$ along the axis 17 to engage with the clutch 12, as discussed below. The logic circuit 24 is further configured to generate a second control signal to operate the electric actuator 18 to displace the cam 16 in the second direction $D_2$ along the cam axis 17 to disengage from the clutch 12.

In use, the electronic clutch mechanism 10 of the lock actuator assembly 9 functions in the following manner. When the input device 22 has not been utilized or an incorrect input has been entered therein, the logic circuit 24 does not generate a control signal to operate the electric actuator 18. As such, the cam 16 does not advance into engagement with the clutch 12, and the clutch 12 remains disposed in the first, nonengaged position $C_1$. If a user rotates the handle portion 8 of the input spindle 4, the input spindle 4 rotates within the input block 130 and about the assembly axis 11, while the clutch 12 and output spindle 3 remain substantially stationary with respect to the assembly axis 11. As such, the latch 5 of the lockset 6 remains in the locked position, preferably engaged with the strike of a door frame (neither shown).

However, if the user enters the appropriate input into the input device 22, the logic circuit generates and transmits a control signal to the electric actuator 18 to cause the actuator 18 to displace the cam 16 in the first direction $D_1$ along the cam axis 17 and into engagement with the clutch 12. The clutch 12 is thereby displaced from the first, nonengaged position $C_1$ to the second, engaged position $C_2$, such that the clutch 12 becomes coupled with the input spindle 4. Thereafter, rotation of the handle portion 8 causes the input spindle 4, the clutch 12 and the output spindle 3 to rotate about the assembly axis 11 generally as a single unit, so as to displace the output cam 7 between the first and second output cam positions (described above). Such movement of the output cam 7 causes the latch 5 to be moved from the locked position to the unlocked position, thereby enabling the door 2 to be moved relative to the door frame (not shown).

Preferably, the logic circuit 24 is further configured to generate another control signal when another appropriate input is entered into the input device 22, or after the lapse of a predetermined period of time (e.g., 5 seconds), to cause the electric actuator 18 to displace the cam 16 in the second direction $D_2$ along the cam axis 17, and thereby out of engagement with the clutch 12. Once the cam 16 disengages from the clutch 12, the spring 48 displaces the clutch 12 from the second, engaged position $C_2$ to the first, nonengaged position $C_1$, thereby uncoupling the second, input spindle 4 from the first, output spindle 3. The input spindle 4 is thereafter again freely rotatable about the assembly axis 11 such that movement of the handle 8 does not effect movement of the latch 5.

It will be appreciated by those skilled in the art that changes could be made to the embodiments or constructions described above without departing from the broad inventive concept thereof. It is understood, therefore, that this invention is not limited to the particular embodiments or constructions disclosed, but it is intended to cover modifications within the spirit and scope of the present invention as recited in the appended claims.

What is claimed is:

1. A shield device for a threaded fastener of a lock assembly, the lock assembly being adjustable between an inoperable state and an operable state and including a housing, the shield device comprising:

a barrier movably disposeable within the housing and configured to displace between a first position at which the barrier at least partially covers the threaded fastener and a second position at which the threaded fastener is generally accessible, wherein the barrier is completely disposed within the housing in the second position, the barrier being disposeable in the first position when the lock assembly is arranged in the inoperable state and being disposeable in the second position when the lock assembly is arranged in the operable state.

2. The shield device as recited in claim 1 wherein the lock assembly includes a member configured to adjust the lock assembly between the operable and inoperable states, the barrier being configured to couple with the member such that when the lock member adjusts the lock assembly between the operable and inoperable states, the barrier displaces between the first and second positions.

3. The shield device as recited in claim 1 wherein the lock assembly further includes a member movable between a first position and a second position, the barrier being configured to couple with the lock member such that movement of the lock member between the lock member first and second positions displaces the barrier between the barrier first and second positions.

4. The shield device as recited in claim 3 further comprising a link having a first end configured to connect with the lock member and a second end connected with the barrier, wherein movement of the lock member displaces the link such that the link displaces the barrier.

5. The shield device as recited in claim 4 wherein the link includes an elongated body and the barrier includes a plate attached to the body.

6. The shield device as recited in claim 3 wherein the lock assembly is disposeable in a first, operable state and alternatively disposeable in a second, inoperable state, the lock member is configured to adjust the lock assembly between the operable and inoperable states, and the barrier is configured to prevent access to the fastener when the lock is disposed in the inoperable state and to permit access to fastener when the lock assembly is disposed in the operable state.

7. The lock assembly as recited in claim 1 wherein the fastener is configured to mount the housing to one of a door and a door frame.

8. A lock assembly comprising:

a housing;

a fastener having a fastener head and a threaded portion;

a lock member movable between first and second positions; and a barrier movably disposed within the housing and displaceable between a first position at which the barrier at least partially covers the fastener head and a second position at which the fastener head is generally accessible, the barrier being coupled with the lock member such that the barrier displaces from the barrier first and second positions when the lock member displaces between the lock member first and second positions.

9. A shield device for preventing access to a fastener of a lock assembly, the fastener operable to connect the lock assembly to a door, the lock assembly including a housing, the shield device comprising:

a barrier disposable within the housing and configured to be displaceable between a first position at which the barrier at least partially covers the fastener to inhibit removal of the lock assembly from the door and a second position at which the barrier is spaced from the fastener such that the fastener is generally accessible to allow removal of the fastener to remove the lock assembly from the door, wherein the barrier is completely disposed within the housing in the second position; and means for displacing the barrier between the first and second positions.

* * * * *